US010717615B2

(12) United States Patent
Chen et al.

(10) Patent No.: US 10,717,615 B2
(45) Date of Patent: Jul. 21, 2020

(54) PAPER PICKUP MECHANISM

(71) Applicant: Foxlink Image Technology Co., Ltd., New Taipei (TW)

(72) Inventors: Ching Jui Chen, New Taipei (TW); Kuan Cheng Huang, New Taipei (TW); Yung Kai Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 16/244,136

(22) Filed: Jan. 10, 2019

(65) Prior Publication Data

US 2019/0248608 A1 Aug. 15, 2019

(30) Foreign Application Priority Data

Feb. 12, 2018 (TW) ..... 107202129 U

(51) Int. Cl.
*B65H 3/52* (2006.01)
*B65H 3/06* (2006.01)

(52) U.S. Cl.
CPC ..... *B65H 3/0607* (2013.01); *B65H 3/523* (2013.01); *B65H 3/5261* (2013.01); *B65H 3/5284* (2013.01); *B65H 2402/545* (2013.01); *B65H 2403/92* (2013.01)

(58) Field of Classification Search
CPC .. B65H 3/5261; B65H 3/5284; B65H 3/5276; B65H 3/523; B65H 3/5215; B65H 3/063; B65H 3/34; B65H 2402/545
See application file for complete search history.

(56) References Cited

U.S. PATENT DOCUMENTS 5,039,080 A * 8/1991 Kato ..... B65H 3/5223 271/122
7,621,522 B2 * 11/2009 Yasukawa ..... B65H 3/063 271/114

(Continued)

FOREIGN PATENT DOCUMENTS

JP 59128139 A * 7/1984 ..... B63H 3/5284
JP 60128146 A * 7/1985

(Continued)

*Primary Examiner* — Luis A Gonzalez
(74) *Attorney, Agent, or Firm* — Lin & Associates Intellectual Property, Inc.

(57) ABSTRACT

A paper pickup mechanism includes a mechanical frame, a pickup roller module, a feeding roller module, a driving device, a separation roller module and an energy storage element. The mechanical frame has a platform. The pickup roller module is pivoted to and connected to the mechanical frame. The feeding roller module is pivoted to and connected to the mechanical frame. The driving device is mounted to the mechanical frame. The separation roller module is pivoted to and connected to the mechanical frame. The energy storage element is mounted between the mechanical frame and the separation roller module. When the separation roller module rotates together with the feeding roller module in a forward direction, the energy storage element accumulates energies. When more than one piece of paper is fed into the paper pickup mechanism, the energy storage element releases the energies.

14 Claims, 22 Drawing Sheets

(56) References Cited

U.S. PATENT DOCUMENTS

| | | | | |
|---|---|---|---|---|
| 7,980,550 | B2 * | 7/2011 | Chou | B65H 3/5215 271/121 |
| 2007/0296139 | A1 * | 12/2007 | Chen | B65H 3/5261 271/121 |
| 2014/0306403 | A1 * | 10/2014 | Shimonaga | B65H 5/062 271/274 |

FOREIGN PATENT DOCUMENTS

| | | | | |
|---|---|---|---|---|
| JP | 07315605 | A * | 12/1995 | B65H 3/5261 |
| JP | 2008239304 | A * | 10/2008 | |
| JP | 2011195335 | A * | 10/2011 | |

* cited by examiner

PAPER PICKUP MECHANISM

CROSS-REFERENCE TO RELATED APPLICATION

The present application is based on, and claims priority form, Taiwan Patent Application No. 107202129, filed Feb. 12, 2018, the disclosure of which is hereby incorporated by reference herein in its entirety.

BACKGROUND OF THE INVENTION

1. Field of the Invention

The present invention generally relates to an office equipment, and more particularly to a paper pickup mechanism applied in an office equipment.

2. The Related Art

Referring to FIG. 18 to FIG. 20, a first conventional paper pickup mechanism 100' includes a mechanical frame 10', a first driving device 20', a pickup roller module 30', a feeding roller module 40' and a separation roller module 50'. An upper portion of the mechanical frame 10' has a platform 11' for placing a plurality pieces of paper 200' which are to be fed in. The pickup roller module 30' is pivoted to and connected to the mechanical frame 10'. A part of the pickup roller module 30' is exposed beyond the platform 11' and contacts the plurality pieces of the paper 200' which are to be fed in. The feeding roller module 40' is pivoted to and connected to the mechanical frame 10' and is disposed to a downstream position of the pickup roller module 30'. A part of the feeding roller module 40' is exposed beyond the platform 11'.

The first driving device 20' is mounted to the mechanical frame 10' and is connected with the pickup roller module 30' and the feeding roller module 40'. The first driving device 20' drives the pickup roller module 30' and the feeding roller module 40' to rotate in a forward direction, a piece of the paper 200' of which a surface contacts with at least one of the pickup roller module 30' and the feeding roller module 40' is picked up by the pickup roller module 30' and is fed to a downstream position of the paper pickup mechanism 100' along a paper feeding direction F' and by the at least one of the pickup roller module 30' and the feeding roller module 40'. The paper feeding direction F' is a direction from an upstream position to the downstream position of the paper pickup mechanism 100'. The direction from the upstream position to the downstream position of the paper pickup mechanism 100' is a direction from the pickup roller module 30' to the feeding roller module 40'. The separation roller module 50' and the feeding roller module 40' are pivoted to and connected to the mechanical frame 10' and opposite to each other. The separation roller module 50' abuts against the part of the feeding roller module 40' exposed beyond the platform 11'. The separation roller module 50' is capable of rotating along with the feeding roller module 40'.

When the first conventional paper pickup mechanism 100' picks up the plurality pieces of the paper 200' normally, front ends of the plurality pieces of the paper 200' abut against a surface of the separation roller module 50', the lowest piece of the paper A1' contacts the pickup roller module 30' and the feeding roller module 40', the pickup roller module 30' and the feeding roller module 40' rotate in the forward direction, the lowest piece of the paper A1' is picked up by the pickup roller module 30' and is fed to the downstream position of the first conventional paper pickup mechanism 100' by the at least one of the pickup roller module 30' and the feeding roller module 40'. The separation roller module 50' cooperates with the feeding roller module 40' to separate the plurality pieces of the paper 200', just let the lowest piece of the paper A1' passed, the other pieces of the paper 200' are blocked.

However, when the plurality pieces of the paper 200' are placed on the platform 11' or in a process of picking up each piece of the paper 200', the front ends of the plurality pieces of the paper 200' which are to be fed are stacked up and down and are mutually staggered at times, the lowest piece of the paper A1' is appeared to be without contacting the feeding roller module 40' and just contact the pickup roller module 30'. When the plurality pieces of the paper 200' are fed into the first conventional paper pickup mechanism 100', a second lowest piece of the paper A2' of which a front of a bottom surface contacts the feeding roller module 40' and a rear of the bottom surface contacts a top surface of the lowest piece of the paper A1' is fed in the forward direction and in advance, in the meanwhile, the pickup roller module 30' will pick up the lowest piece of the paper A1' of which a bottom surface contacts the pickup roller module 30' and feeds the lowest piece of the paper A1' to the feeding roller module 40', subsequently, the feeding roller module 40' will feed the lowest piece of the paper A1' and the second lowest piece of the paper A2' in the forward direction simultaneously. As a result, a phenomenon of multiple pieces of the paper 200' being fed in is occurred.

Referring to FIG. 21 and FIG. 22, in order to prevent occurring the phenomenon of the multiple pieces of the paper 200' being fed in, a second conventional paper pickup mechanism 300' will be equipped with a second driving device 60'. The second driving device 60' is connected with the separation roller module 50' for driving the separation roller module 50' to continue rotating in a reverse direction opposite to the forward direction, when the plurality pieces of the paper 200' are fed normally, the separation roller module 50' rotates in the reverse direction, just let the lowest piece of the paper A1' pass, and the other pieces of the paper 200' are blocked, when the phenomenon of the multiple pieces of the paper 200' being fed in is appeared, the fed multiple pieces of the paper 200' will be returned on account of the separation roller module 50' continues rotating in the reverse direction, a friction force between the separation roller module 50' and the second lowest piece of the paper A2' is greater than a friction force between the lowest piece of the paper A1' and the second lowest piece of the paper A2', just let the lowest piece of the paper A1' pass. As a result, the phenomenon of the multiple pieces of the paper 200' will be without being occurred.

However, the second conventional paper pickup mechanism 300' need be equipped with one more driving device that makes a manufacturing cost of the second conventional paper pickup mechanism 300' higher, and in addition the second conventional paper pickup mechanism 300' need occupy a larger space.

SUMMARY OF THE INVENTION

An object of the present invention is to provide a paper pickup mechanism. The paper pickup mechanism includes a mechanical frame, a pickup roller module, a feeding roller module, a driving device, a separation roller module and an energy storage element. The mechanical frame has a platform for placing at least one piece of paper. The pickup roller module is pivoted to and connected to the mechanical frame. A part of the pickup roller module is exposed beyond the platform and contacts the at least one piece of the paper. The feeding roller module is pivoted to and connected to the mechanical frame, and the feeding roller module is disposed to a downstream position of the pickup roller module. A part of the feeding roller module is exposed beyond the platform. The driving device is mounted to the mechanical frame. The driving device is connected with the pickup roller module and the feeding roller module. The driving device drives the pickup roller module and the feeding roller module to rotate in a forward direction. The at least one piece of the paper of which a surface contacts at least one of the pickup roller module and the feeding roller module is picked up, and the at least one piece of the paper of which the surface contacts the at least one of the pickup roller module and the feeding roller module is fed to a downstream position of the paper pickup mechanism. The separation roller module is pivoted to and connected to the mechanical frame, and the separation roller module is opposite to the feeding roller module. The separation roller module is capable of abutting against the part of the feeding roller module exposed beyond the platform, and the separation roller module is capable of rotating along with the feeding roller module. The separation roller module cooperates with the feeding roller module to separate the at least one piece of the paper. The separation roller module includes a separation shaft pivoted to and connected to the mechanical frame, and a separation roller pivoted around and connected to the separation shaft. The separation roller abuts against the part of the feeding roller module exposed beyond the platform. The energy storage element is mounted between the mechanical frame and the separation roller module. When the separation roller module rotates together with the feeding roller module in the forward direction, the energy storage element accumulates energies. When more than one piece of the paper is fed into the paper pickup mechanism, the energy storage element releases the energies to make the separation roller module rotate in a reverse direction opposite to the forward direction and return fed superfluous paper which is fed into the paper pickup mechanism out of order. The energy storage element is a torsion spring. The torsion spring has a spring body worn around the separation shaft. The spring body is located at one side of the separation roller. One end of the spring body has a first spring foot fastened to one end of the separation shaft, and the other end of the spring body has a second spring foot fastened to the mechanical frame. The one end of the separation shaft is fastened with a first fastening shaft. An outer peripheral surface of an outer end of the first fastening shaft protrudes outward to form a first protruding block. The first protruding block opens a clamping slot longitudinally penetrating through the first protruding block and the first spring foot is clamped in the clamping slot.

Another object of the present invention is to provide a paper pickup mechanism. The paper pickup mechanism includes a mechanical frame, a pickup roller module, a feeding roller module, a separation roller module and an energy storage element. The mechanical frame has a platform for placing at least one piece of paper. The mechanical frame is provided with a blocking board connected with a driving device. The driving device drives the blocking board to alternately move towards a paper blocking position and a paper releasing position relative to the platform. The pickup roller module is pivoted to and connected to the mechanical frame, and contacts the at least one piece of the paper. The feeding roller module is pivoted to and connected to the mechanical frame, and the feeding roller module is disposed to a downstream position of the pickup roller module. The separation roller module is pivoted to and connected to the mechanical frame. The separation roller module is opposite to the feeding roller module. The separation roller module is capable of abutting against the feeding roller module. The energy storage element is mounted between the mechanical frame and the separation roller module. When the separation roller module rotates together with the feeding roller module in a forward direction, the energy storage element accumulating energies, when more than one piece of the paper is fed into the paper pickup mechanism, the energy storage element releasing the energies to make the separation roller module rotate in a reverse direction opposite to the forward direction and return fed superfluous paper which is fed into the paper pickup mechanism out of order. The blocking board is disposed among the pickup roller module, the feeding roller module and the separation roller module. When the blocking board moves to the paper blocking position for blocking each piece of the paper which is to be fed in, a distance between the blocking board, and a contact point of the pickup roller module and the paper which is to be fed in and contacts the pickup roller module is less than or equal to an energy storage trip of the energy storage element, when the at least one piece of the paper is picked up, the blocking board moves towards the paper releasing position, the pickup roller module and the feeding roller module rotate in the forward direction, the pickup roller module brings along a front end of the at least one piece of the paper abuts against a surface of a separation roller of the separation roller module, respectively.

As described above, when the separation roller module rotates together with the feeding roller module, the paper pickup mechanism accumulates the energies by virtue of the energy storage element being mounted between the separation roller module and the mechanical frame, when more than one piece of the paper is fed into the paper pickup mechanism, the energy storage element releases the energies to make the separation roller module rotate in the reverse direction opposite to the forward direction and return the fed superfluous paper which is fed into the paper pickup mechanism out of order, so that a circumstance of more than one piece of the paper being fed in is prevented from being occurred, and correspondingly, a circumstance of the multiple pieces of the paper being fed in is prevented from being occurred. In addition, a manufacturing cost of the paper pickup mechanism is lower, and an occupying space of the paper pickup mechanism is smaller.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
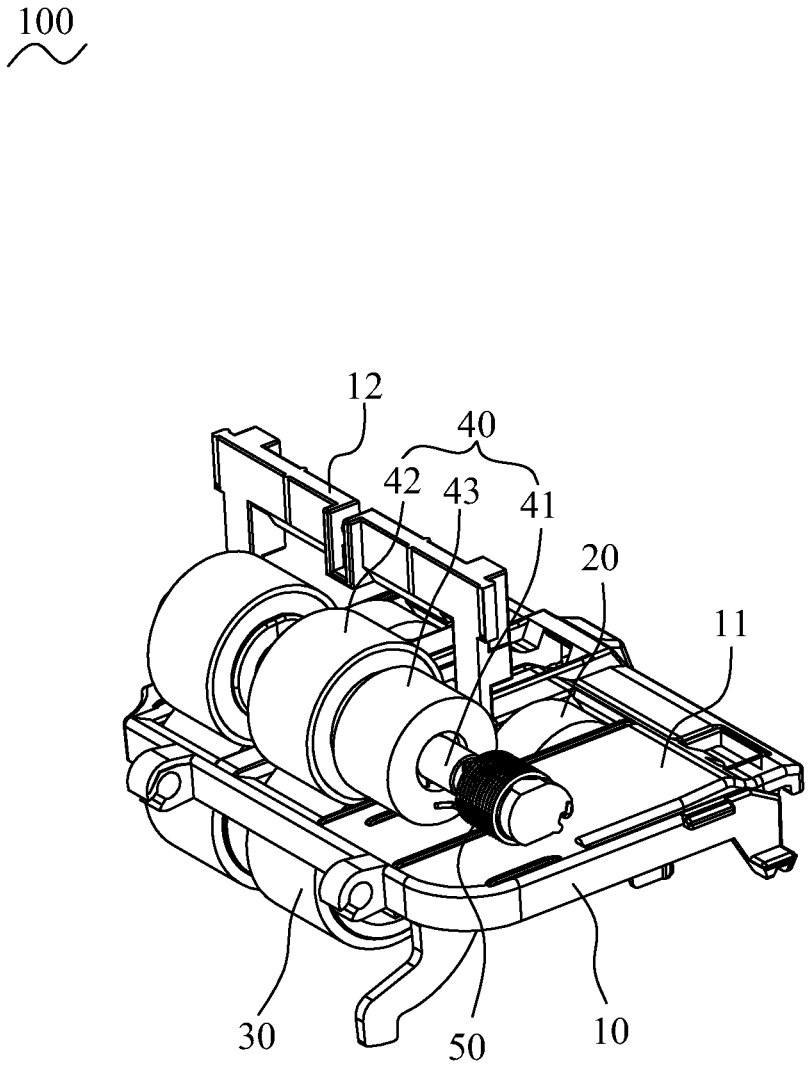
FIG. 1 is a perspective view of a paper pickup mechanism in accordance with a first preferred embodiment of the present invention.
Figure 3:
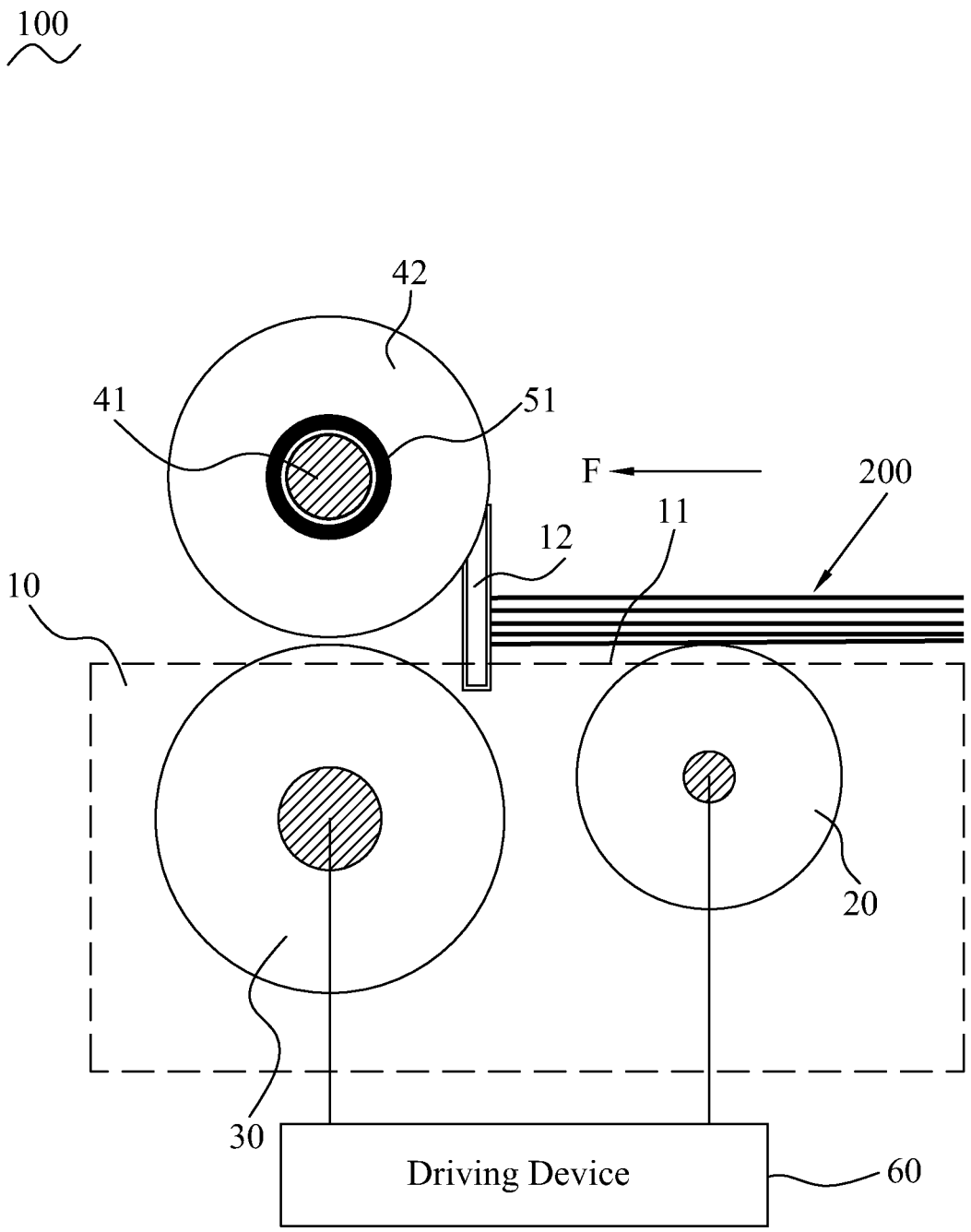
FIG. 3 is a schematic diagram of the paper pickup mechanism in accordance with the first preferred embodiment of the present invention, wherein the paper pickup mechanism is without picking up paper.
Figure 4:
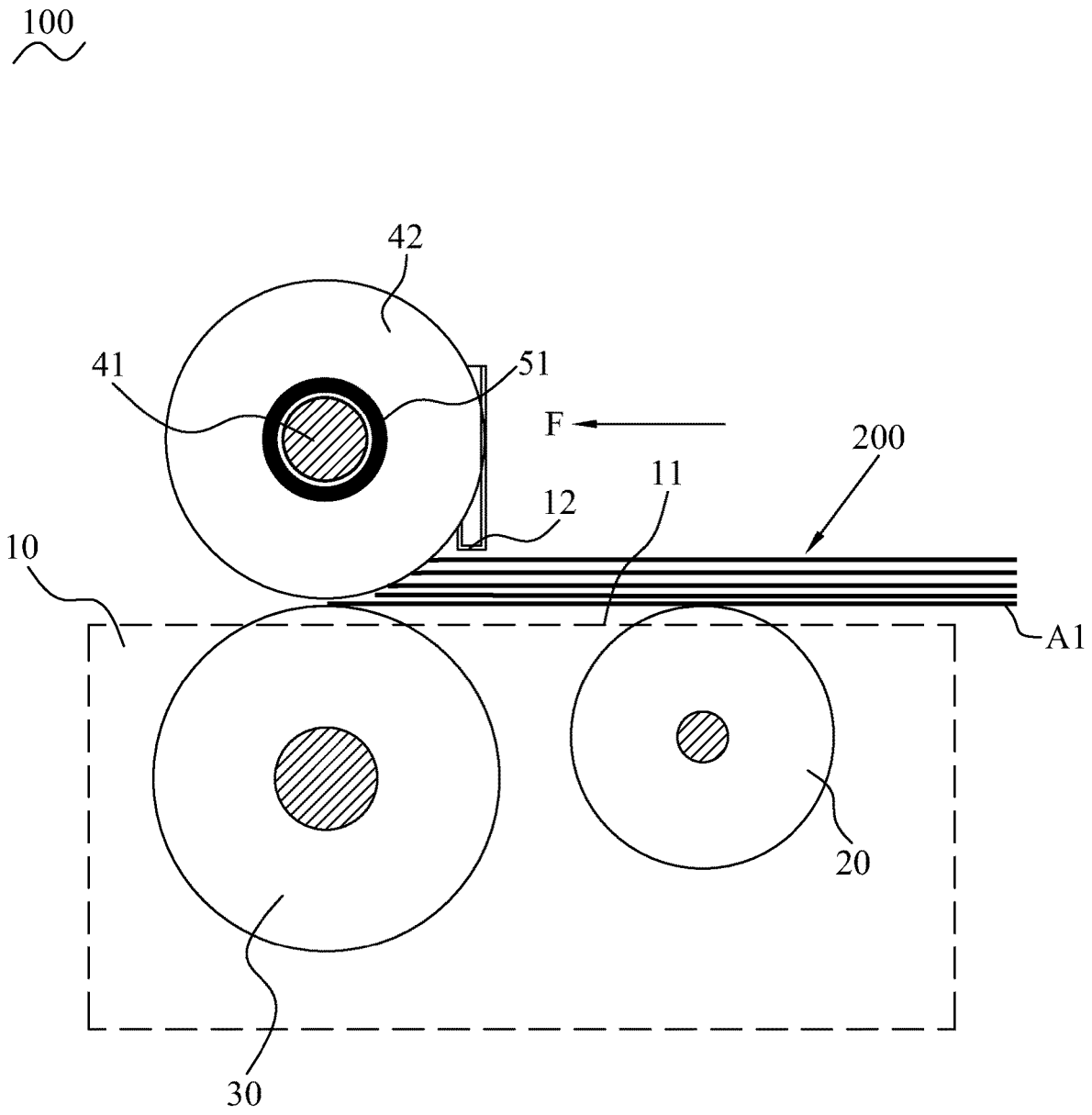
FIG. 4 is a schematic diagram of the paper pickup mechanism in accordance with the first preferred embodiment of the present invention, wherein each piece of the paper is fed into the paper pickup mechanism normally.
Figure 5:
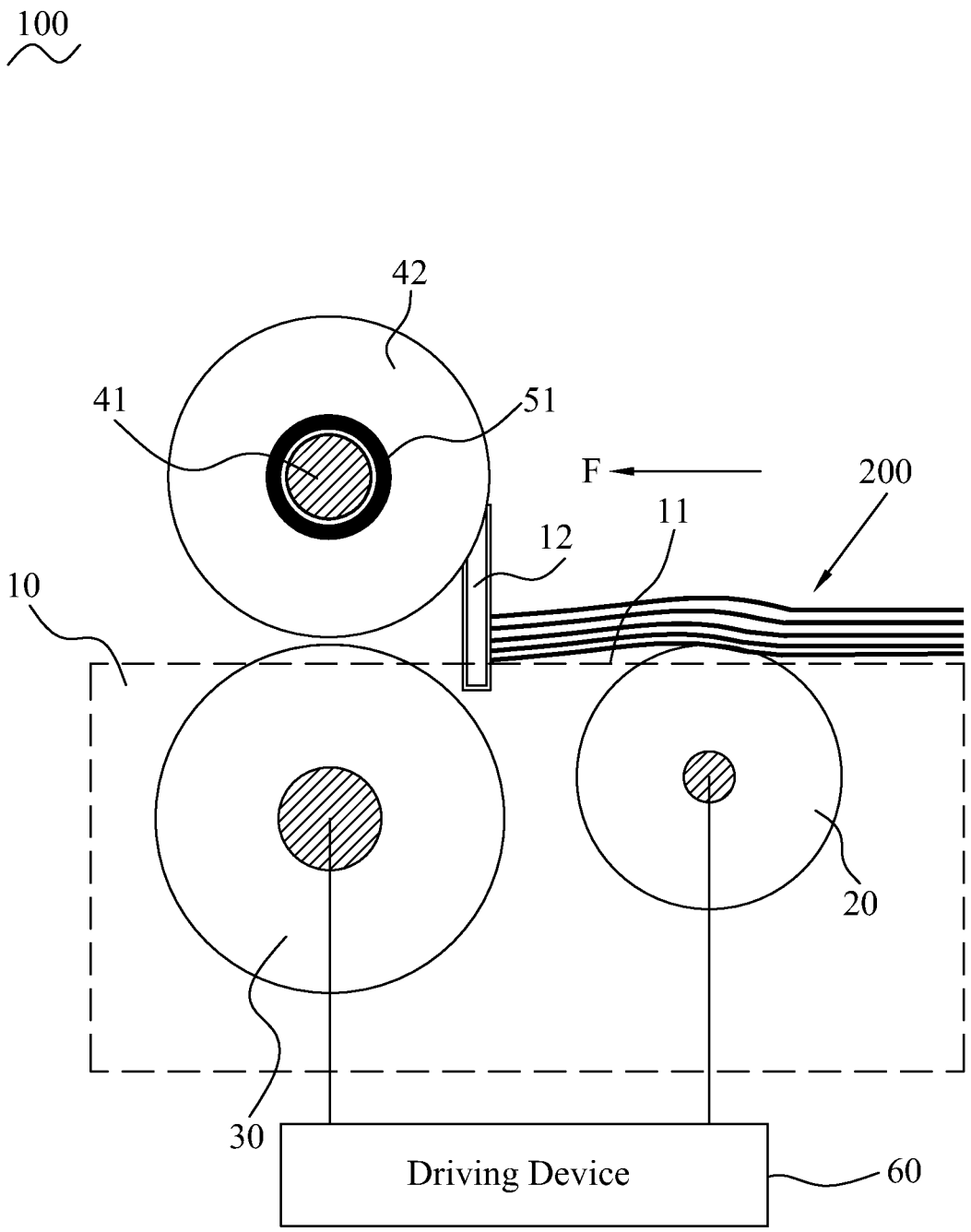
FIG. 5 is a schematic diagram of the paper pickup mechanism in accordance with the first preferred embodiment of the present invention, wherein the paper is without being fed into the paper pickup mechanism.

With reference to FIG. 1 and FIG. 3, a paper pickup mechanism 100 in accordance with a first preferred embodiment of the present invention is shown. The paper pickup mechanism 100 includes a mechanical frame 10, a pickup roller module 20, a feeding roller module 30, a separation roller module 40, an energy storage element 50 and a driving device 60.

With reference to FIG. 1 and FIG. 3, the mechanical frame 10 has a platform 11 for placing at least one piece of paper 200. The pickup roller module 20 is pivoted to and connected to the mechanical frame 10. A part of the pickup roller module 20 is exposed beyond the platform 11 and contacts the at least one piece of the paper 200. In this first preferred embodiment, the platform 11 is used for placing a plurality pieces of paper 200 which are to be fed in. The plurality pieces of the paper 200 are stacked up and down. The part of the pickup roller module 20 is exposed beyond the platform 11 and contacts the plurality pieces of the paper 200. The feeding roller module 30 is pivoted to and connected to the mechanical frame 10, and the feeding roller module 30 is disposed to a downstream position of the pickup roller module 20. A part of the feeding roller module 30 is exposed beyond the platform 11.

Referring to FIG. 1 and FIG. 3, the driving device 60 is mounted to the mechanical frame 10. The driving device 60 is connected with the pickup roller module 20 and the feeding roller module 30. The driving device 60 drives the pickup roller module 20 and the feeding roller module 30 to rotate in a forward direction. The at least one piece of the paper 200 of which a surface contacts at least one of the pickup roller module 20 and the feeding roller module 30 is picked up, and the at least one piece of the paper 200 of which the surface contacts the at least one of the pickup roller module 20 and the feeding roller module 30 is fed to a downstream position of the paper pickup mechanism 100 along a paper feeding direction F. In this first preferred embodiment, a lowest piece of the paper 200 of which a surface contacts the at least one of the pickup roller module 20 and the feeding roller module 30 is picked up, and the lowest piece of the paper 200 of which the surface contacts the at least one of the pickup roller module 20 and the feeding roller module 30 is fed to the downstream position of the paper pickup mechanism 100 along the paper feeding direction F.

Figure 2:
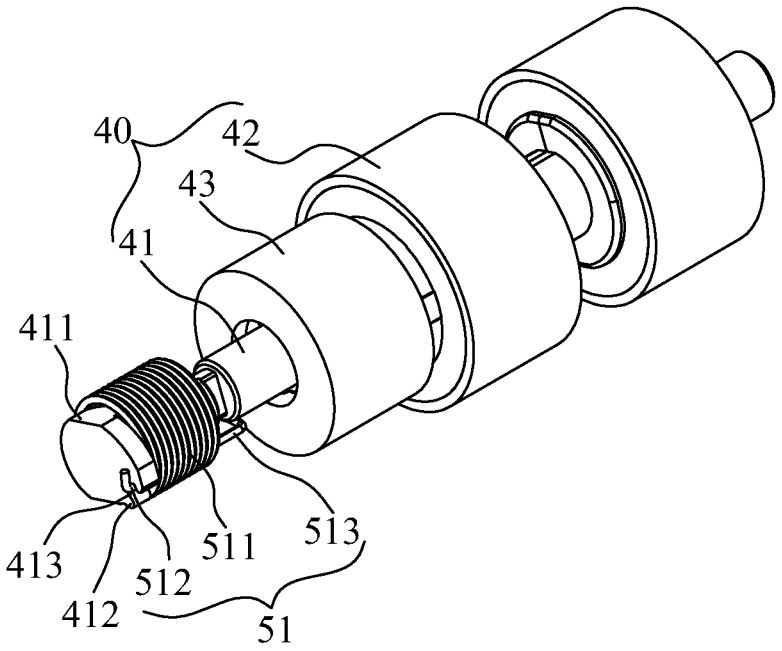
FIG. 2 is a perspective view of the paper pickup mechanism, wherein an energy storage element of the paper pickup mechanism is assembled to a separation roller module of the paper pickup mechanism of FIG. 1.

Referring to FIG. 1 to FIG. 3, the separation roller module 40 is pivoted to and connected to the mechanical frame 10, and the separation roller module 40 is opposite to the feeding roller module 30. The separation roller module 40 is capable of abutting against the part of the feeding roller module 30 exposed beyond the platform 11, and the separation roller module 40 is capable of rotating along with the feeding roller module 30. The separation roller module 40 cooperates with the feeding roller module 30 to separate the at least one piece of the paper 200. In the first preferred embodiment, the separation roller module 40 cooperates with the feeding roller module 30 to separate the plurality pieces of the paper 200. Specifically, the separation roller module 40 includes a separation shaft 41 pivoted to and connected to the mechanical frame 10, and a separation roller 42 pivoted around and connected to the separation shaft 41. The separation roller 42 abuts against the part of the feeding roller module 30 exposed beyond the platform 11. The separation shaft 41 is equipped with a torsion limiter 43. The torsion limiter 43 is buckled with the separation roller 42. The torsion limiter 43 is capable of being fastened with or being loosened from the separation shaft 41. When the torsion limiter 43 is fastened with the separation shaft 41, the separation roller 42 drives the separation shaft 41 to rotate together at the time of the separation roller 42 rotating. When the torsion limiter 43 is loosened from the separation shaft 41, the separation shaft 41 will be without rotating together with the separation roller 42 at the time of the separation roller 42 rotating.

Referring to FIG. 1, FIG. 2, FIG. 3 and FIG. 10, the energy storage element 50 is mounted between the mechanical frame 10 and the separation roller module 40. When the separation roller module 40 rotates together with the feeding roller module 30 in the forward direction, the energy storage element 50 of the paper pickup mechanism 100 accumulates energies. When more than one piece of the paper 200 is fed into the paper pickup mechanism 100, the energy storage element 50 releases the energies to make the separation roller module 40 rotate in a reverse direction opposite to the forward direction and return fed superfluous paper 200 which is fed into the paper pickup mechanism 100 out of order. In the first preferred embodiment, when multiple pieces of the paper 200 are fed into the paper pickup mechanism 100, the energy storage element 50 releases the energies to make the separation roller module 40 rotate in the reverse direction opposite to the forward direction and return the fed superfluous paper 200 which is fed into the paper pickup mechanism 100 out of order. The energy storage element 50 is one of a torsion spring 51, a tension spring 52, a plate spring, a compressed spring and so on.

Referring to FIG. 1 to FIG. 3, in the first preferred embodiment, the energy storage element 50 is the torsion spring 51. The torsion spring 51 has a spring body 511 worn around the separation shaft 41. The spring body 511 is located at one side of the separation roller 42. One end of the spring body 511 has a first spring foot 512 fastened to one end of the separation shaft 41, and the other end of the spring body 511 has a second spring foot 513 fastened to the mechanical frame 10. The one end of the separation shaft 41 is fastened with a first fastening shaft 411. An outer peripheral surface of an outer end of the first fastening shaft 411 protrudes outward to form a first protruding block 412. The first protruding block 412 opens a clamping slot 413 longitudinally penetrating through the first protruding block 412. The first spring foot 512 is clamped in the clamping slot 413.

Figure 10:
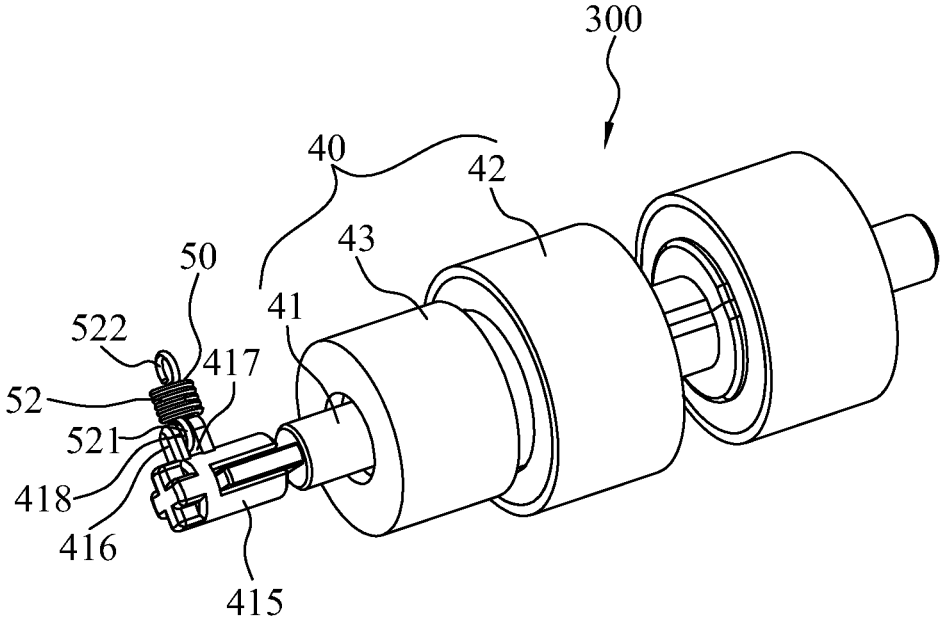
FIG. 10 is a perspective view of a paper pickup mechanism in accordance with a second preferred embodiment of the present invention, wherein an energy storage element of the paper pickup mechanism is assembled to the separation roller module of the paper pickup mechanism.
Figure 11:
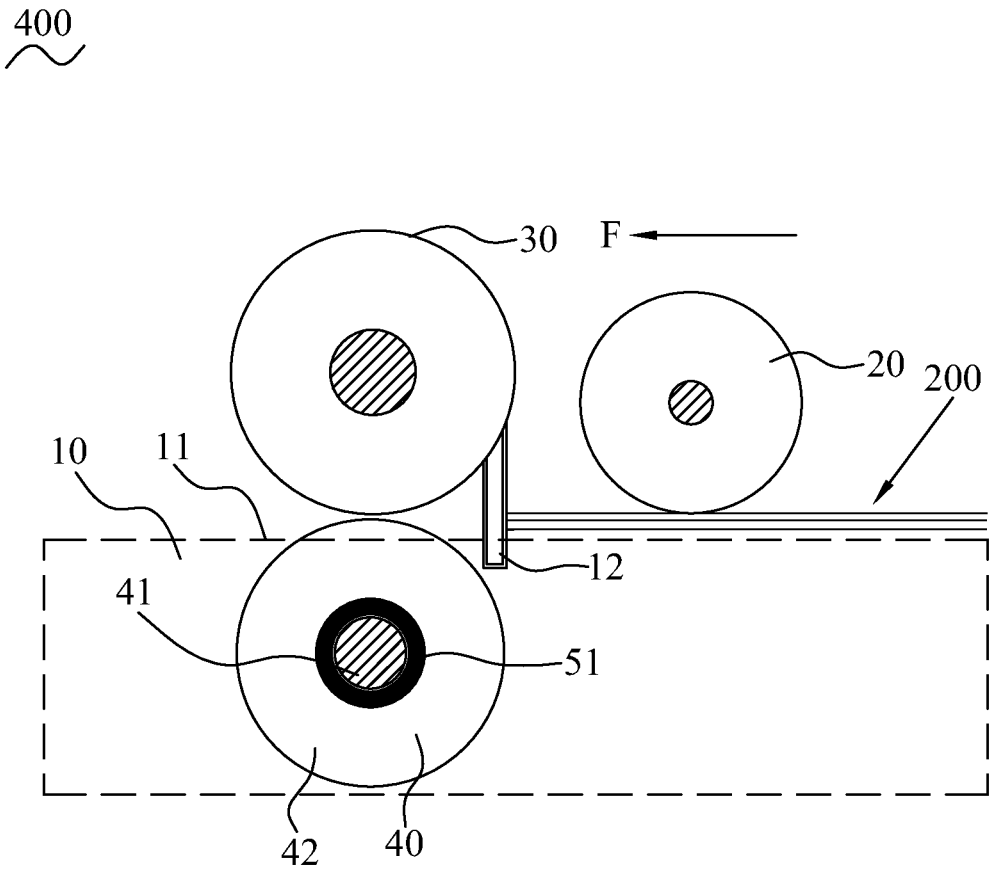
FIG. 11 is a schematic diagram of a paper pickup mechanism in accordance with a third preferred embodiment of the present invention, wherein the paper pickup mechanism is without picking up paper.
Figure 12:
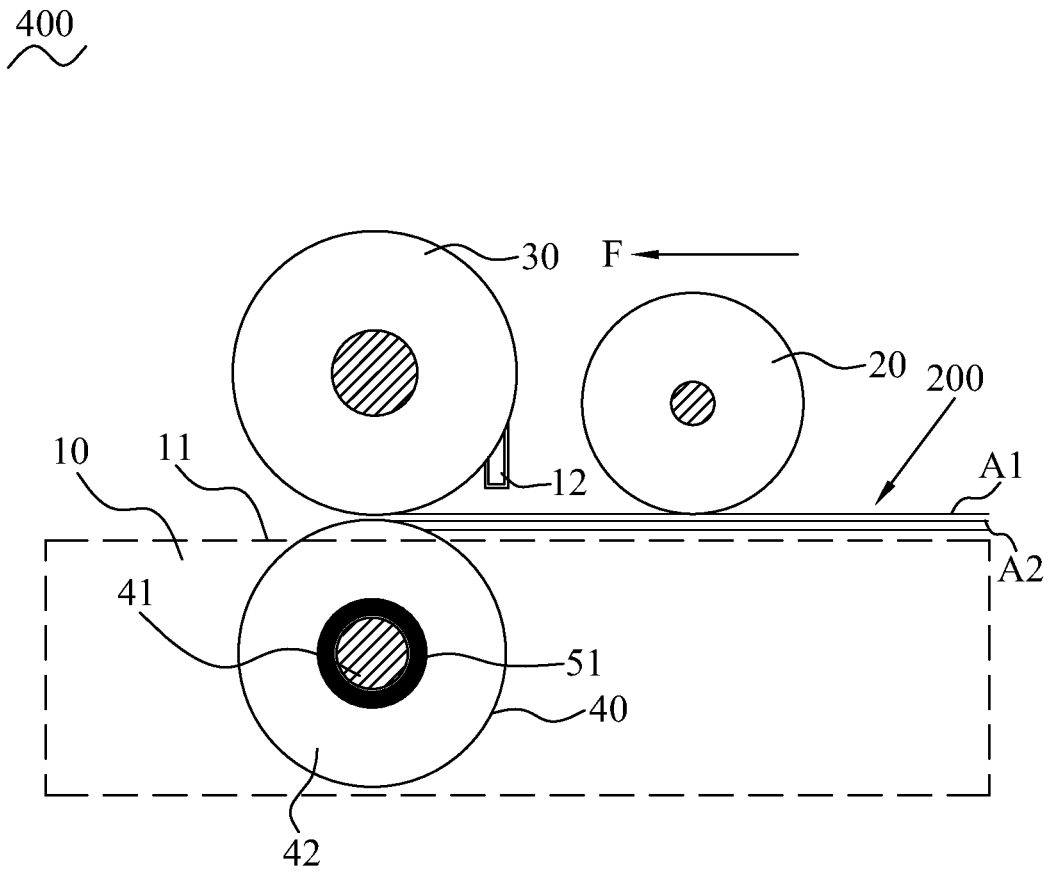
FIG. 12 is a schematic diagram of the paper pickup mechanism in accordance with the third preferred embodiment of the present invention, wherein each piece of the paper is fed into the paper pickup mechanism normally.
Figure 13:
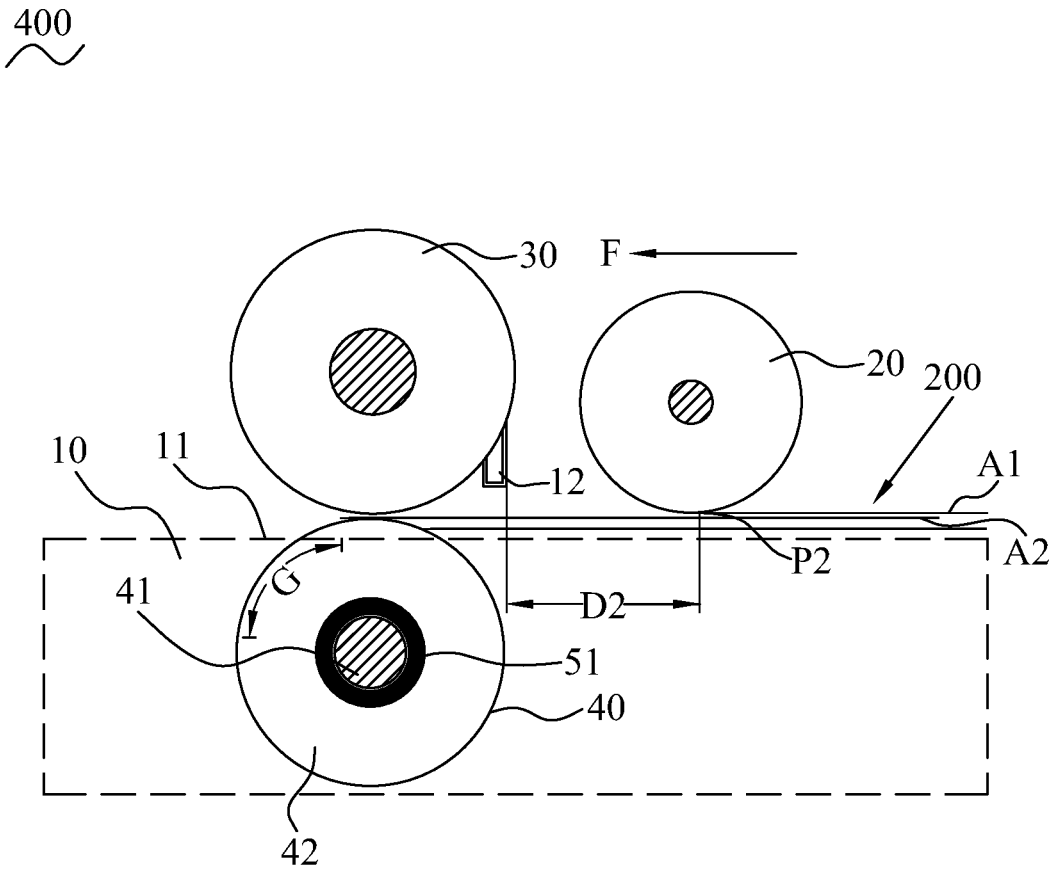
FIG. 13 is a schematic diagram of the paper pickup mechanism in accordance with the third preferred embodiment of the present invention, wherein the paper is fed into the paper pickup mechanism abnormally.
Figure 14:
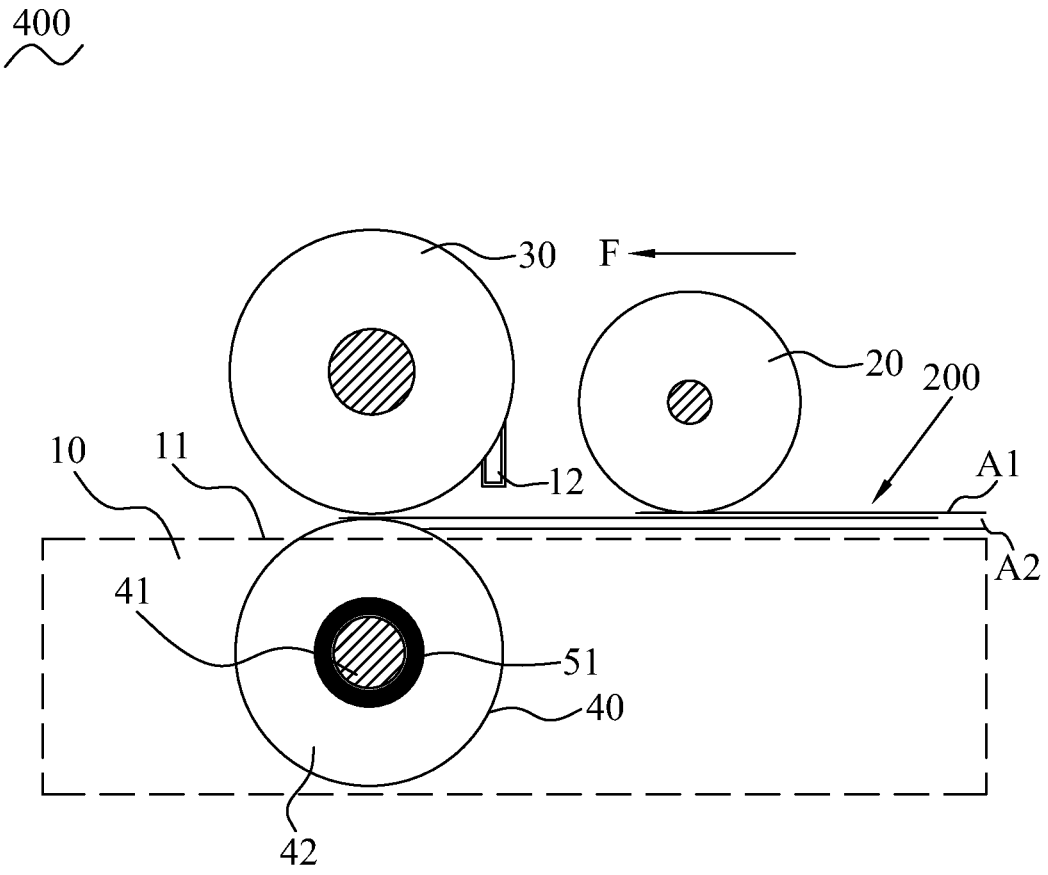
FIG. 14 is another schematic diagram of the paper pickup mechanism in accordance with the third preferred embodiment of the present invention, wherein the paper is fed into the paper pickup mechanism abnormally.
Figure 15:
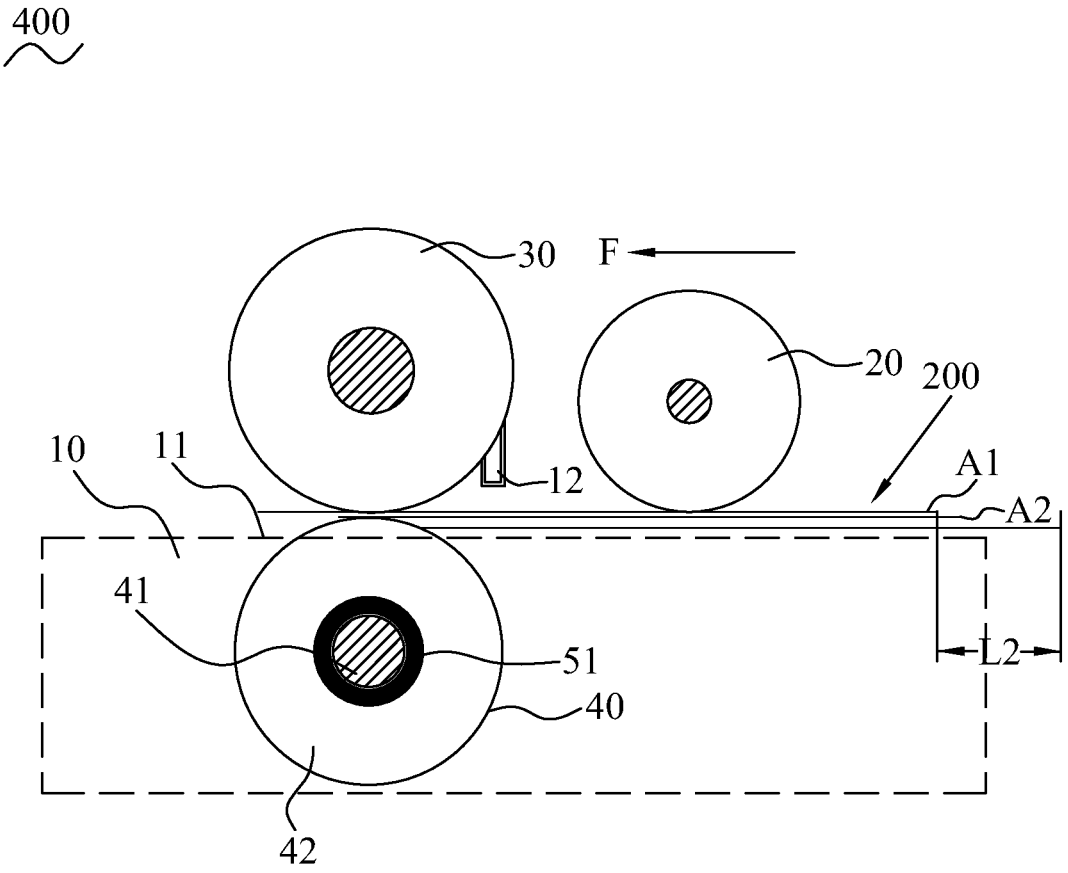
FIG. 15 is a schematic diagram of the paper pickup mechanism in accordance with the third preferred embodiment of the present invention, wherein more than one piece of the paper is fed into the paper pickup mechanism when the paper is fed into the paper pickup mechanism abnormally.
Figure 16:
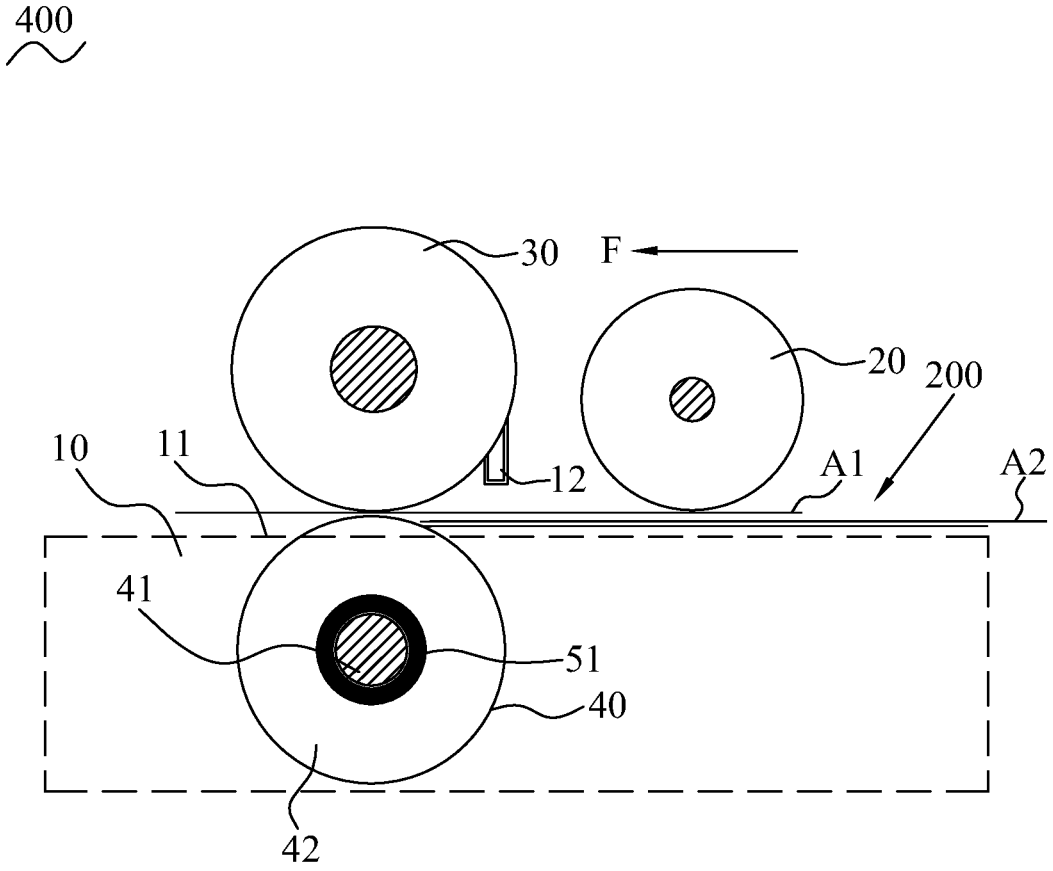
FIG. 16 is a schematic diagram of the paper pickup mechanism in accordance with the third preferred embodiment of the present invention, wherein the separation roller module of the paper pickup mechanism rotates in the reverse direction and the fed superfluous paper which is fed into the paper pickup mechanism out of order is returned.
Figure 17:
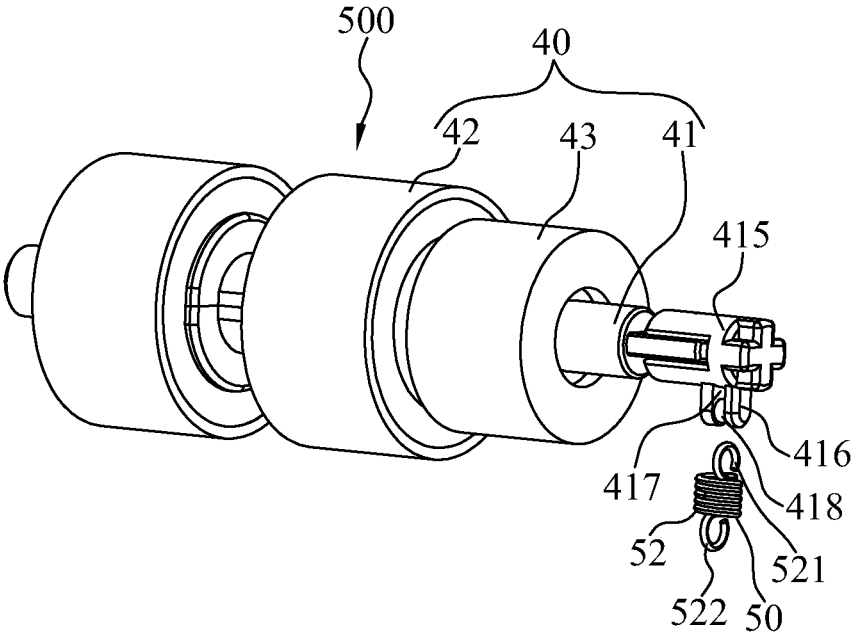
FIG. 17 a perspective view of a paper pickup mechanism in accordance with a fourth preferred embodiment of the present invention, wherein the energy storage element of the paper pickup mechanism is assembled to the separation roller module of the paper pickup mechanism.
Figure 18:
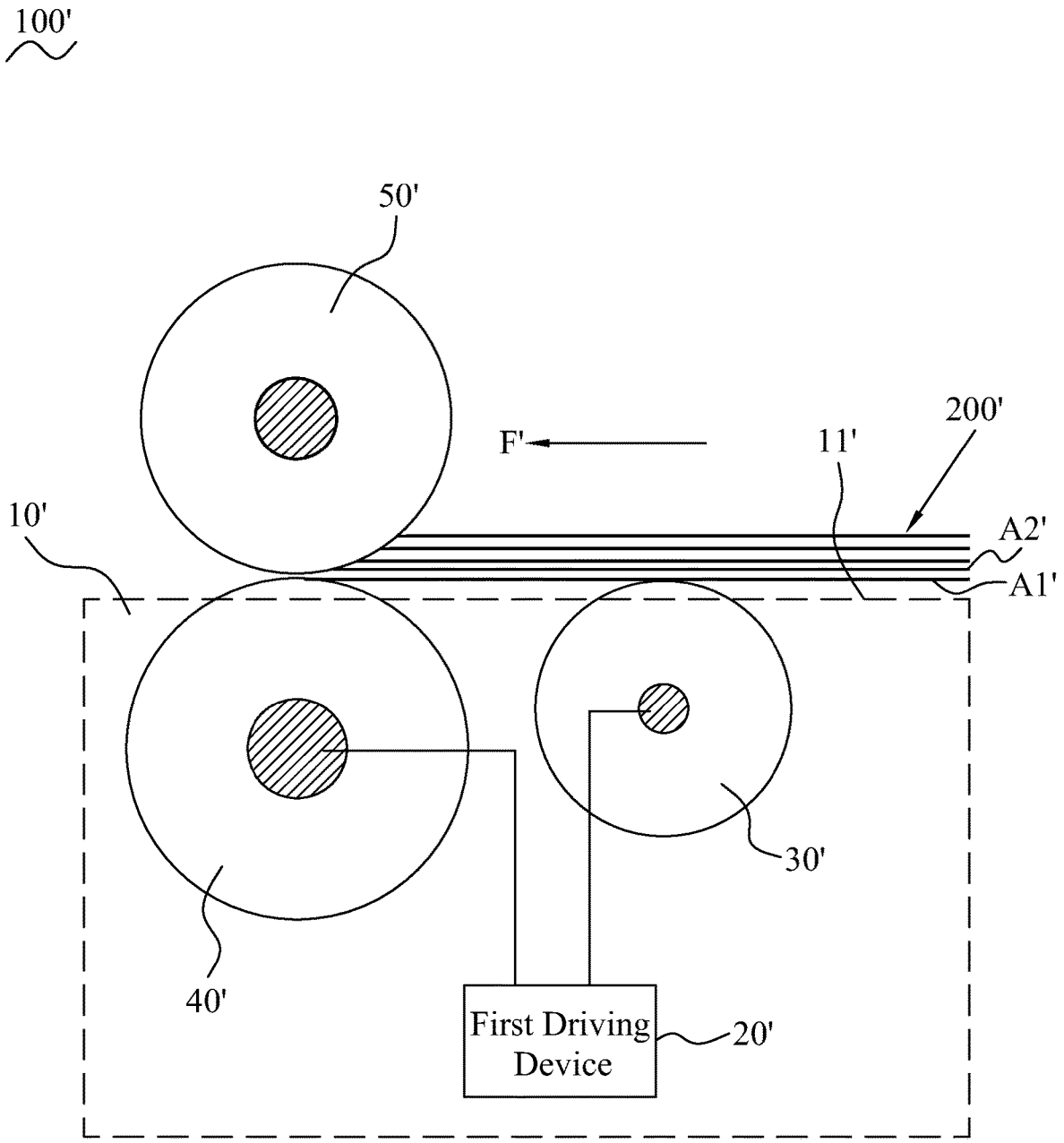
FIG. 18 (Prior Art)
FIG. 18 is a schematic diagram of a first conventional paper pickup mechanism in prior art, wherein a plurality pieces of paper are placed on the first conventional paper pickup mechanism normally.
Figure 19:
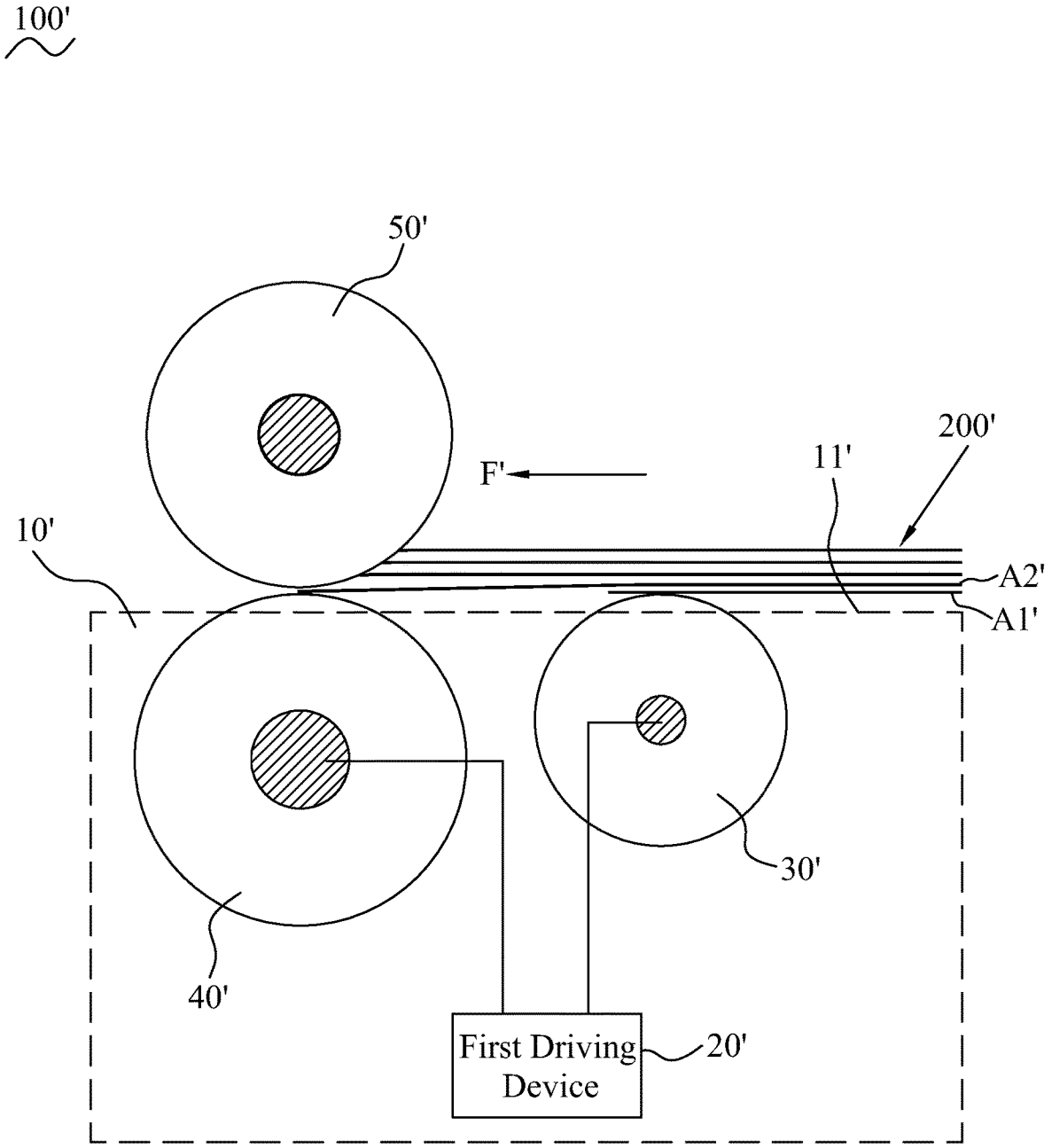
FIG. 19 (Prior Art)
FIG. 19 is another schematic diagram of the first conventional paper pickup mechanism in prior art, wherein the plurality pieces of the paper are placed on the first conventional paper pickup mechanism abnormally.
Figure 20:
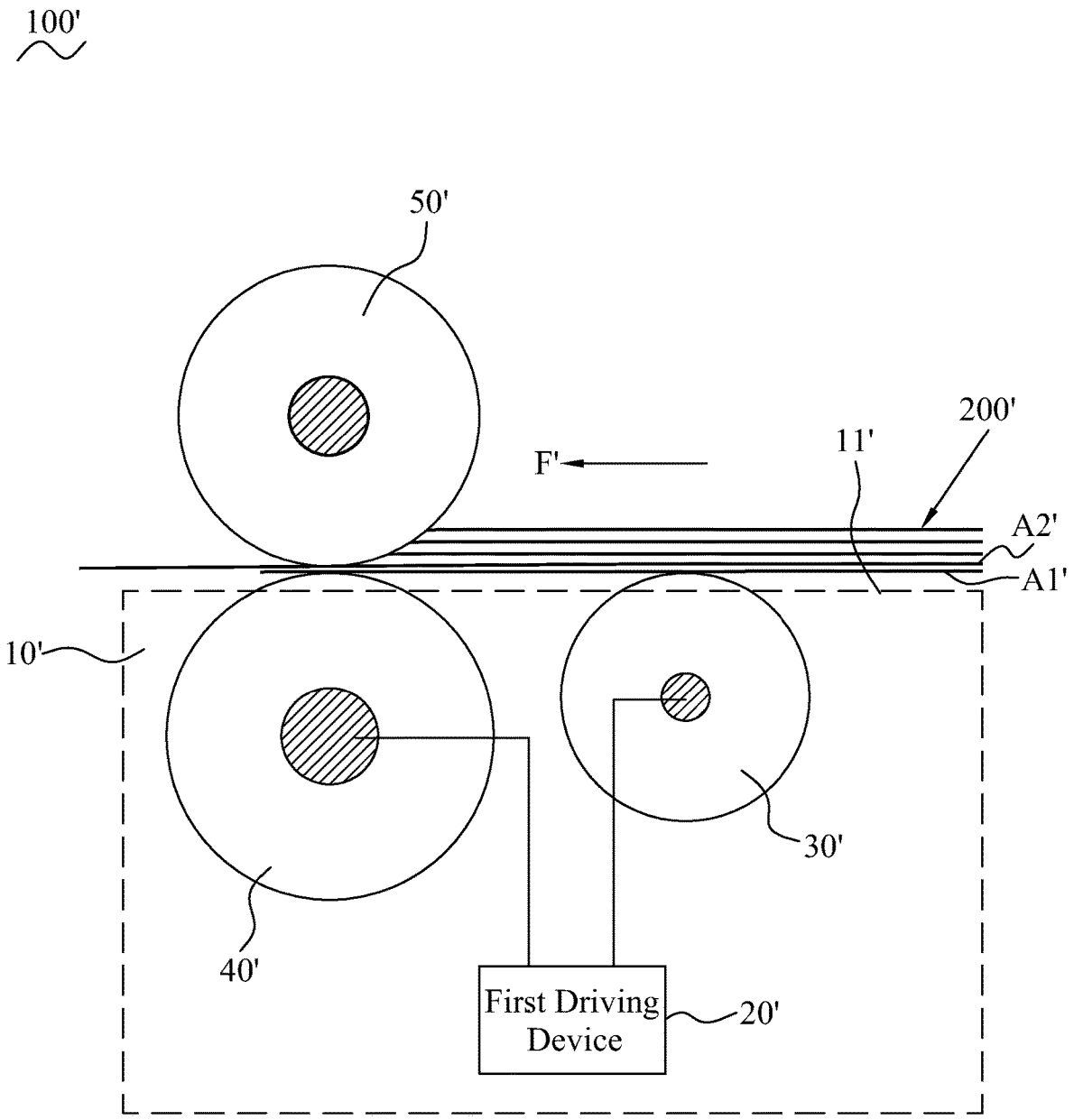
FIG. 20 (Prior Art)
FIG. 20 is a schematic diagram of the first conventional paper pickup mechanism, wherein multiple pieces of the paper are fed into the first conventional paper pickup mechanism in prior art.
Figure 21:
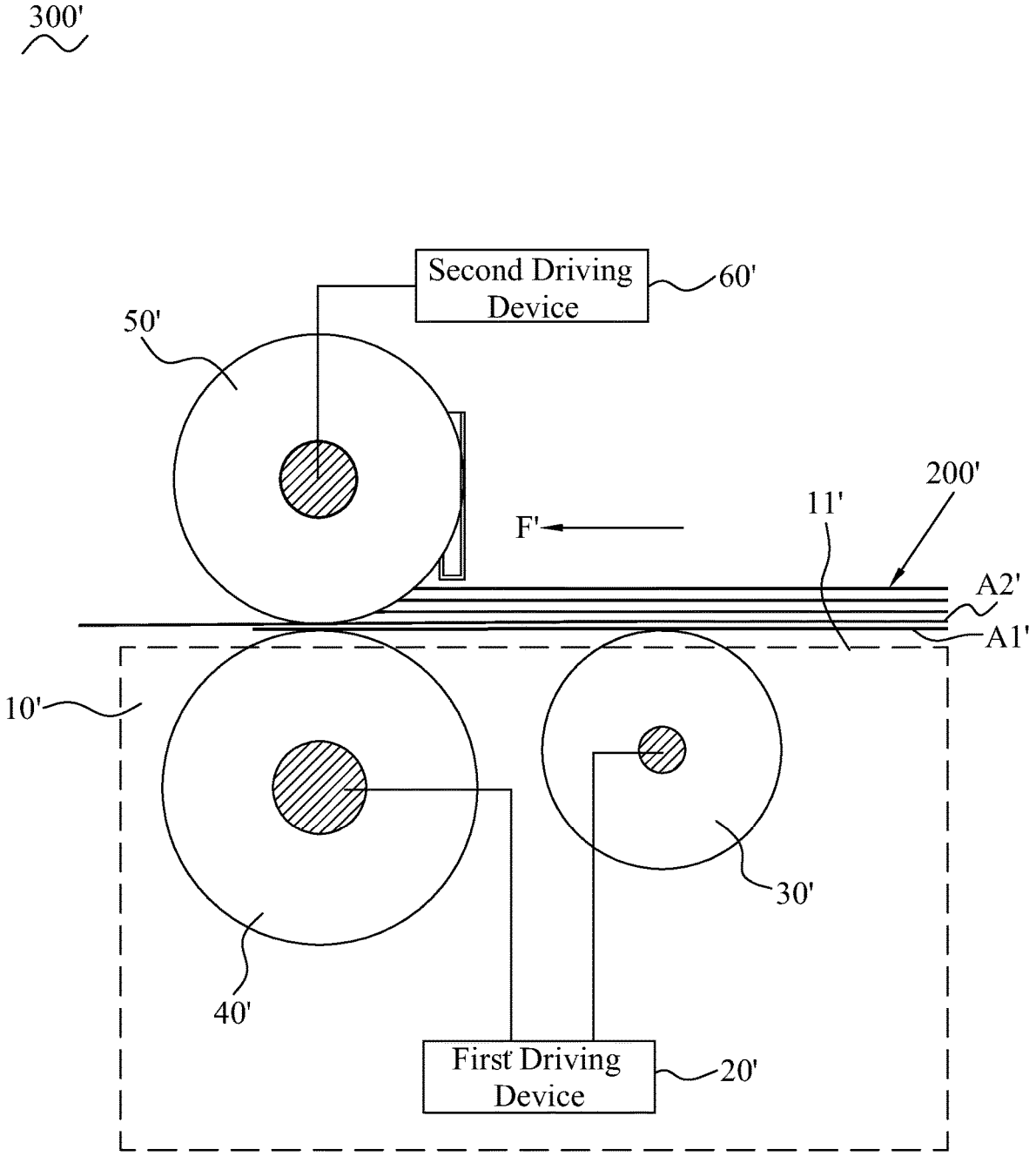
FIG. 21 (Prior Art)
FIG. 21 is a schematic diagram of a second conventional paper pickup mechanism in prior art, wherein the multiple pieces of the paper are fed into the second conventional paper pickup mechanism.
Figure 22:
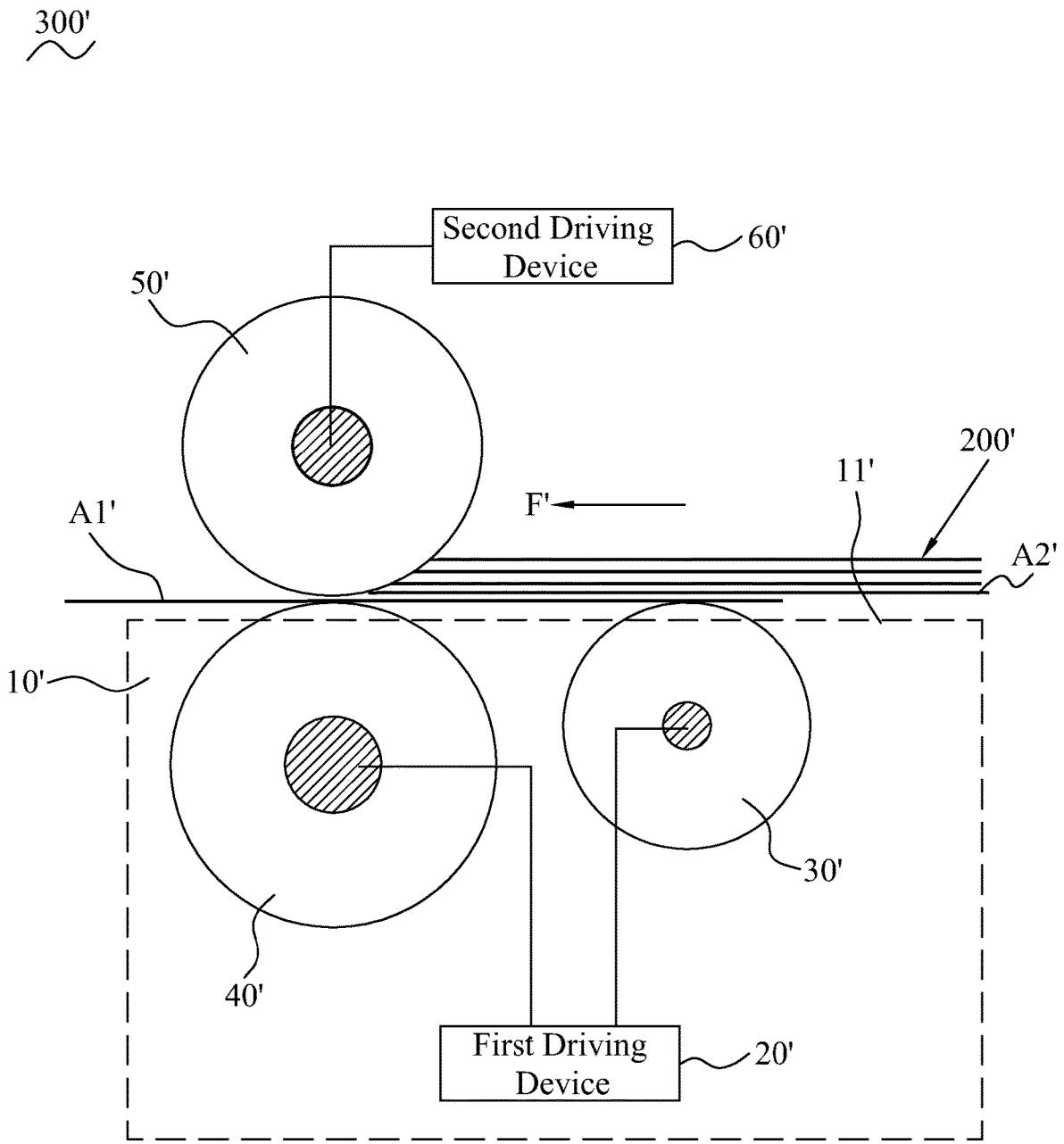
FIG. 22 (Prior Art)
FIG. 22 is a schematic diagram of the second conventional paper pickup mechanism in prior art, wherein a separation roller module of the second conventional paper pickup mechanism rotates in a reverse direction and the fed multiple pieces of the paper are returned.

Referring to FIG. 1 and FIG. 10, a paper pickup mechanism 300 in accordance with a second preferred embodiment of the present invention is shown. Differences between the paper pickup mechanism 100 in accordance with the first preferred embodiment and the paper pickup mechanism 300 in accordance with the second preferred embodiment are described as follows. The energy storage element 50 is the tension spring 52. One end of the tension spring 52 has a semicircular first fastening foot 521 fastened to the one end of the separation shaft 41, and the other end of the tension spring 52 has a semicircular second fastening foot 522 fastened to the mechanical frame 10. The one end of the separation shaft 41 is fastened with a second fastening shaft 415. One side of an outer peripheral surface of an outer end of the second fastening shaft 415 protrudes outward to form a second protruding block 416. The second protruding block 416 opens a fastening hole 417. The first fastening foot 521 is fastened in the fastening hole 417. A middle of one side wall of the fastening hole 417 is of a lying cylinder shape and is defined as a fastening cylinder 418. The first fastening foot 521 is of the semicircular shape and is worn around the fastening cylinder 418.

Figure 6:
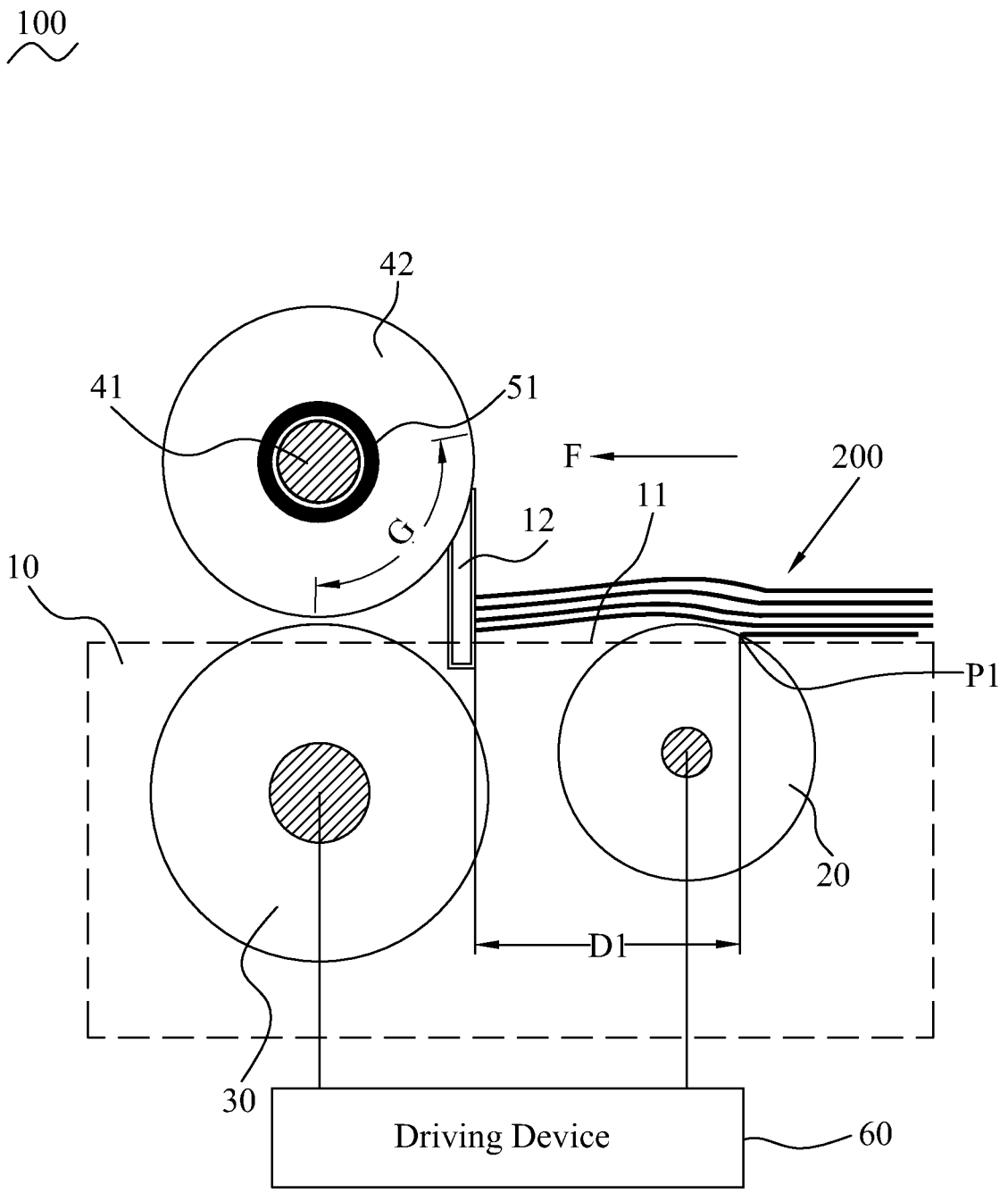
FIG. 6 is another schematic diagram of the paper pickup mechanism of FIG. 5, wherein the paper is without being fed into the paper pickup mechanism.
Figure 7:
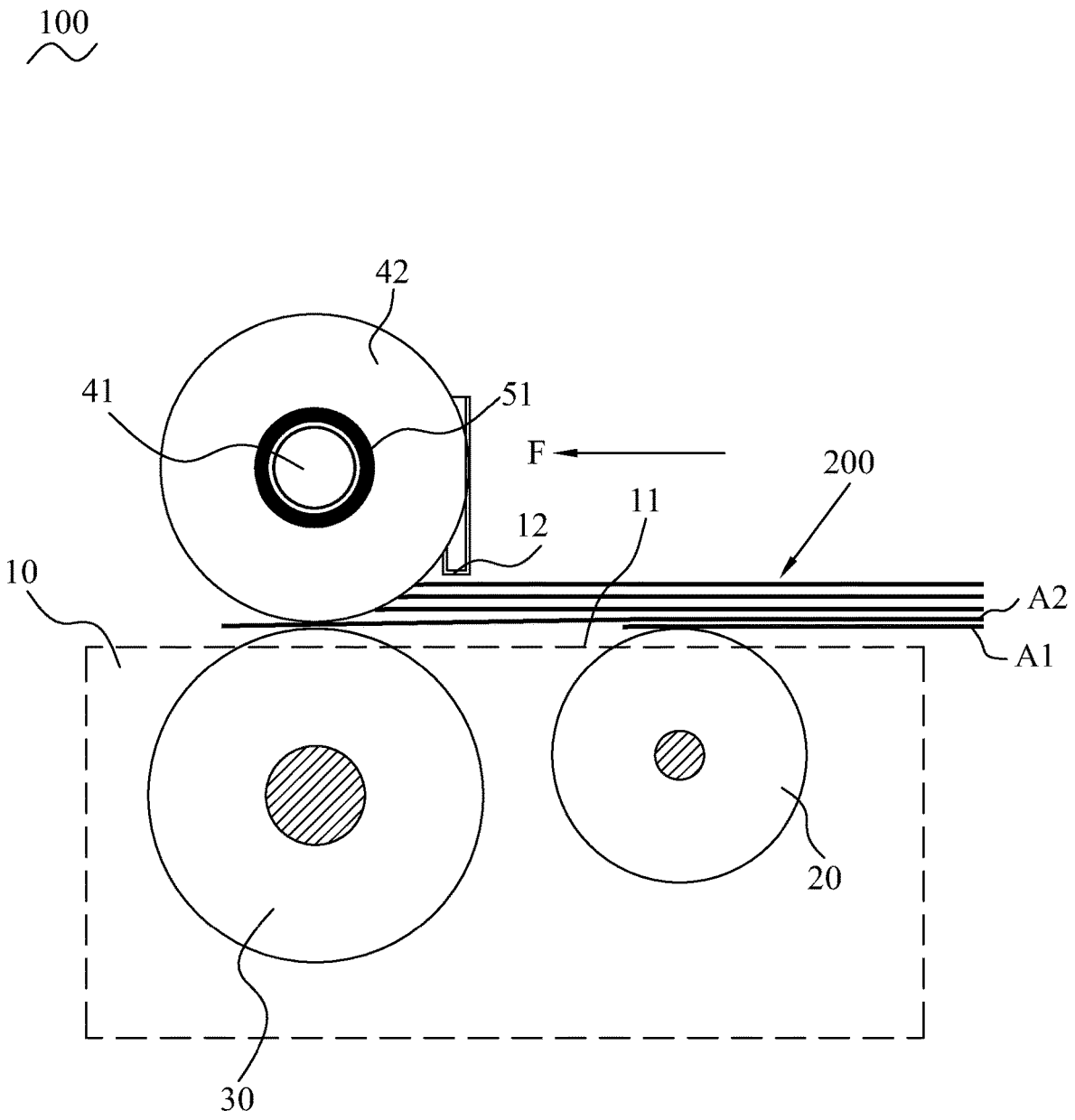
FIG. 7 is a schematic diagram of the paper pickup mechanism in accordance with the first preferred embodiment of the present invention, wherein the paper is fed into the paper pickup mechanism abnormally.
Figure 8:
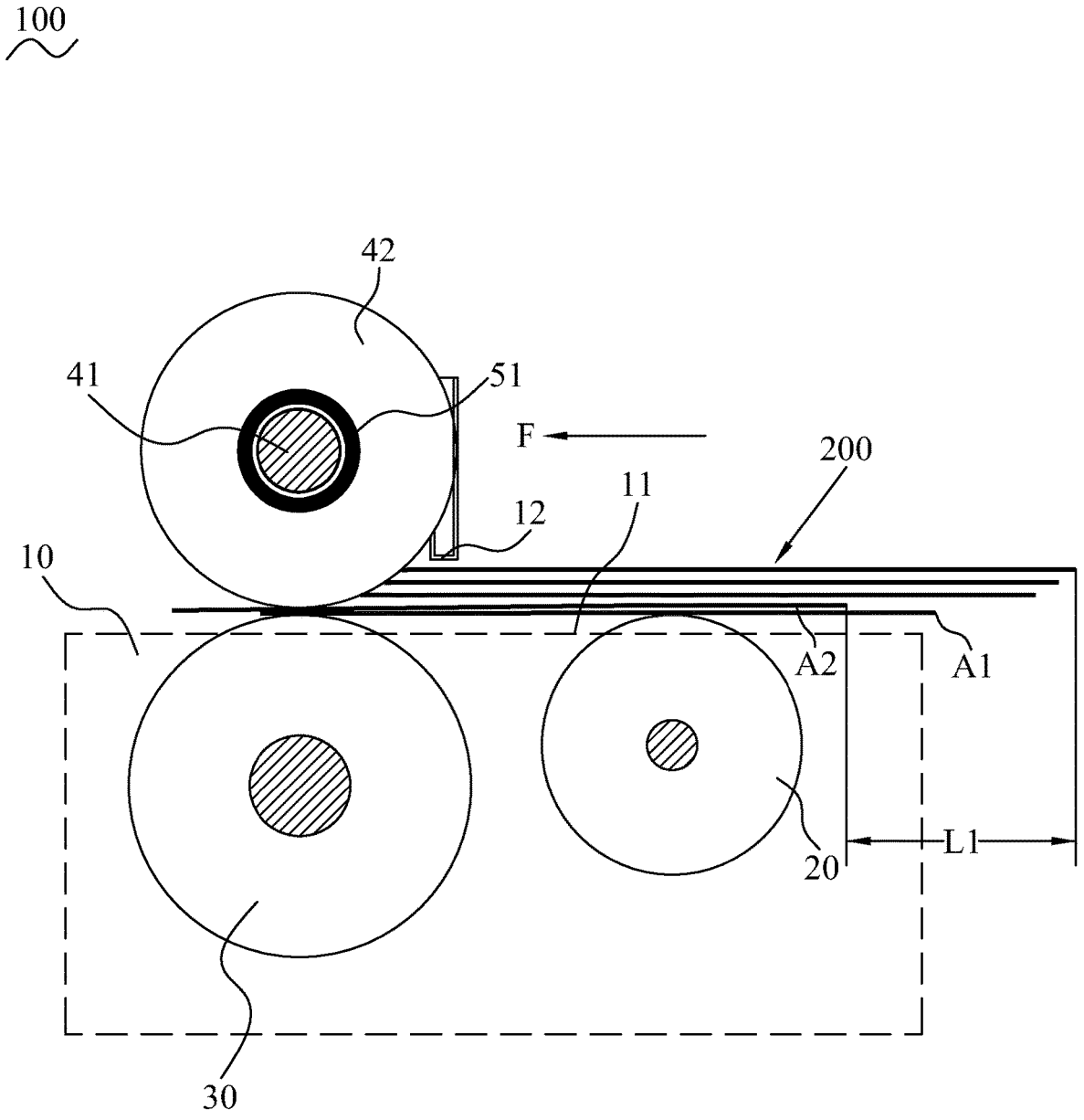
FIG. 8 is a schematic diagram of the paper pickup mechanism of FIG. 7, wherein more than one piece of the paper is fed into the paper pickup mechanism when the paper is fed into the paper pickup mechanism abnormally.
Figure 9:
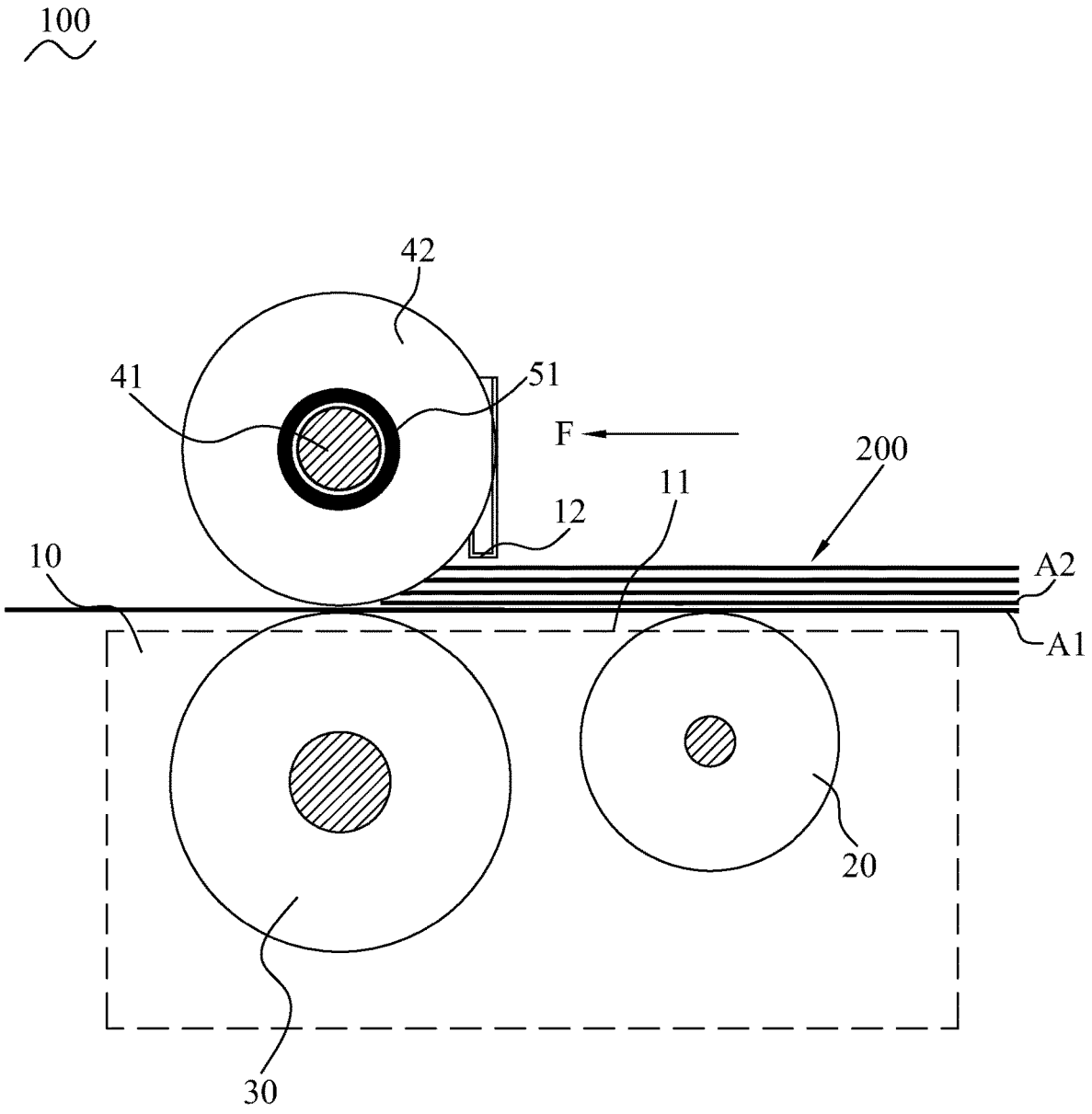
FIG. 9 is a schematic diagram of the paper pickup mechanism in accordance with the first preferred embodiment of the present invention, wherein the separation roller module of the paper pickup mechanism rotates in a reverse direction and fed superfluous paper which is fed into the paper pickup mechanism out of order is returned abnormally.

Referring to FIG. 1, FIG. 3 and FIG. 6, the mechanical frame 10 is provided with a blocking board 12. The blocking board 12 is connected with the driving device 60. The driving device 60 drives the blocking board 12 to alternately move towards a paper blocking position and a paper releasing position relative to the platform 11. The blocking board 12 is disposed among the pickup roller module 20, the feeding roller module 30 and the separation roller module 40. When the blocking board 12 moves to the paper blocking position for blocking each piece of the paper 200 which is to be fed in, a distance D1 between the blocking board 12, and a contact point P1 of the pickup roller module 20 and the lowest piece of the paper 200 which is to be fed in and contacts the pickup roller module 20 is less than or equal to an energy storage trip G of the energy storage element 50. $G=N*\Pi*R/180$, G is the energy storage trip, and the energy storage trip G is a rotation arc length of the separation roller 42 of the separation roller module 40 driven by the energy storage element 50; R is a radius of the separation roller 42 driven by the energy storage element 50; Π is Pi; N is a rotation angle of the separation roller 42 driven by the energy storage element 50. A largest rotation angle of the separation roller 42 driven by the energy storage element 50 is confirmed according to a design specification of the paper pickup mechanism 100. The rotation angle of the separation roller 42 driven by the energy storage element 50 is capable of being 90 degrees, so the rotation arc length of the separation roller 42 of the separation roller module 40 driven by the energy storage element 50 is capable of being a quarter of a perimeter of the separation roller 42. The contact point P1 is located between an upstream position of a surface of the pickup roller module 20 and the lowest piece of the paper 200 which is to be fed in and contacts the pickup roller module 20.

Referring to FIG. 1 to FIG. 9, a working principle of the paper pickup mechanism 100 is described as follows. At an original status, the blocking board 12 moves to be located at the paper blocking position and blocks the at least one piece of paper 200 which is to be fed in. When the at least one piece of the paper 200 is picked up by the paper pickup mechanism 100, the blocking board 12 moves towards the paper releasing position, the pickup roller module 20 and the feeding roller module 30 rotate in the forward direction, the pickup roller module 20 brings along a front end of the at least one piece of the paper 200 abuts against a surface of the separation roller 42 of the separation roller module 40, respectively. In the first preferred embodiment, the blocking board 12 moves to be located at the paper blocking position and blocks the plurality pieces of the paper 200 which are to be fed in. When the plurality pieces of the paper 200 are picked up by the paper pickup mechanism 100, the blocking board 12 moves towards the paper releasing position, the pickup roller module 20 and the feeding roller module 30 rotate in the forward direction, the pickup roller module 20 brings along front ends of the plurality pieces of the paper 200 abut against the surface of the separation roller 42 of the separation roller module 40, respectively. The pickup roller module 20 and the feeding roller module 30 pick up the lowest piece of the paper A1 abutting against the pickup roller module 20 and the feeding roller module 30, and the pickup roller module 20 and the feeding roller module 30 feed the lowest piece of the paper A1 abutting against the pickup roller module 20 and the feeding roller module 30 to the downstream position of the paper pickup mechanism 100. The feeding roller module 30 cooperates with the separation roller module 40 to separate the plurality pieces of the paper 200 to block the fed superfluous paper 200, so that just the lowest piece of the paper A1 is fed to the downstream position of the paper pickup mechanism 100. When the blocking board 12 moves towards the paper releasing position, the energy storage element 50 starts proceeding accumulating the energies for a first time, and the energy storage element 50 completes accumulating the energies before a front end of one piece of the paper 200 abuts against the separation roller 42 of the separation roller module 40.

In the first preferred embodiment, when each piece of the paper 200 is fed into the paper pickup mechanism 100 normally, the torsion limiter 43 is fastened with the separation shaft 41 to make the separation roller 42 and the separation shaft 41 of the separation roller module 40 rotate together with the feeding roller module 30, the spring body 511 of the torsion spring 51 is compressed and the spring body 511 of the torsion spring 51 of the paper pickup mechanism 100 accumulates the energies by virtue of the first spring foot 512 and the second spring foot 513, when the torsion spring 51 is compressed to a first preset elasticity value, the separation roller 42 stops rotating, the feeding roller module 30 continues rotating in the forward direction, the feeding roller module 30 exerts a friction force on the separation roller 42, namely a friction force between the separation roller module 40, and the feeding roller module 30 together with the fed paper 200 is generated. After the friction force between the separation roller module 40, and the feeding roller module 30 together with the fed paper 200 reaches a preset friction value, the torsion limiter 43 is loosened from the separation shaft 41 to make the separation roller 42 rotate along with the feeding roller module 30, the separation shaft 41 keeps a relative fixation. When each piece of the paper 200 is fed into the paper pickup mechanism 100 normally, the energy storage element 50 will be without releasing the energies.

Referring to FIG. 1, FIG. 3, FIG. 4, FIG. 6 and FIG. 10, in the second preferred embodiment, when each piece of the paper 200 is fed into the paper pickup mechanism 300 normally, the torsion limiter 43 is fastened with the separation shaft 41 to make the separation roller 42 and the separation shaft 41 of the separation roller module 40 to rotate together with the feeding roller module 30. The tension spring 52 stretches and accumulates the energies by virtue of the first fastening foot 521 and the second fastening foot 522. When the tension spring 52 is stretched to a second preset elasticity value, the separation roller 42 stops rotating, the feeding roller module 30 continues rotating in the forward direction, the feeding roller module 30 exerts the friction force on the separation roller 42. After the friction force between the separation roller module 40, and the feeding roller module 30 together with the fed paper 200 reaches the preset friction value, the torsion limiter 43 is loosened from the separation shaft 41 to make the separation roller 42 rotate together with the feeding roller module 30, whereas, the separation shaft 41 keeps the relative fixation.

Referring to FIG. 1 to FIG. 9, when the plurality pieces of the paper 200 are fed into the paper pickup mechanism 100 under an abnormal placement status, the paper A1 abutting against the pickup roller module 20 is located at an upstream position of the paper A2 located to a top of the paper A1 and is without contacting the feeding roller module 30. A distance L1 between a tail end of one piece of the paper 200 nearest to the pickup roller module 20 and a tail end of another piece of the paper 200 furthest to the pickup roller module 20 is smaller than the distance D1 between the blocking board 12, and the contact point P1 of the pickup roller module 20 and the lowest piece of the paper 200 which is to be fed in and contacts the pickup roller module 20. When each piece of the paper 200 is fed into the paper pickup mechanism 100, the pickup roller module 20 and the feeding roller module 30 rotate, the separation roller module 40 rotates together with the feeding roller module 30 and accumulates the energies, the feeding roller module 30 drives the paper A2 to be fed to the downstream position of the paper pickup mechanism 100, the pickup roller module 20 picks up the paper A1, and the paper A1 is fed to the downstream position of the paper pickup mechanism 100, when the paper A1 is fed to an abutting point between the separation roller 42 and the feeding roller module 30, the paper A1 contacts the feeding roller module 30, at the moment, the paper A2 just contacts with the separation roller 42 and is without contacting with the feeding roller module 30.

Because a friction force between the paper A1 and the paper A2 is smaller than a friction force between the separation roller 42 and the paper A2, so that the friction force exerted on the separation roller 42 by the feeding roller module 30 is smaller. When the friction force exerted on the separation roller 42 by the feeding roller module 30 is less than the preset friction value, namely the friction force between the separation roller module 40, and the feeding roller module 30 together with the fed paper 200 is less than the preset friction value, the separation roller 42 stops rotating together with the feeding roller module 30, the torsion limiter 43 will be fastened with the separation shaft 41, the energy storage element 50 which is the torsion spring 51, the tension spring 52, the plate spring, the compressed spring and so on, releases the energies to make the separation shaft 41 and the separation roller 42 rotate in the reverse direction to drive the paper A2 to slip, and return to an upstream position of the paper pickup mechanism 100, the feeding roller module 30 continues feeding the lowest piece of the paper A1 to the downstream position of the paper pickup mechanism 100. The energy storage element 50 is capable of returning the paper A2 which is fed into the paper pickup mechanism 100 out of order to an upstream position of a contacting area of the separation roller 42 and the paper 200. The energy storage element 50 is capable of returning the paper A2 which is fed into the paper pickup mechanism 100 out of order to an upstream position of a contacting area of the separation roller 42 and the paper A2. After an abnormal piece of the paper 200 is excluded to be fed in, the paper pickup mechanism 100 returns to a status of picking up and feeding each piece of the paper 200 normally again, the energy storage element 50 continues proceeding accumulating the energies next time.

Referring to FIG. 1 to FIG. 16, a paper pickup mechanism 400 in accordance with a third preferred embodiment of the present invention is shown. Differences between the paper pickup mechanism 400 in accordance with the third preferred embodiment and the paper pickup mechanism 100 in accordance with the first preferred embodiment are described as follows.

A part of the separation roller module 40 is exposed beyond the platform 11 and contacts the at least one piece of the paper 200. A top of the separation roller 42 is exposed beyond the platform 11 and contacts the at least one piece of the paper 200. In this third preferred embodiment, the part of the separation roller module 40 is exposed beyond the platform 11 and contacts the plurality pieces of the paper 200. The top of the separation roller 42 is exposed beyond the platform 11 and contacts the plurality pieces of the paper 200.

The feeding roller module 30 is disposed above the platform 11. The feeding roller module 30 is disposed to a top of the separation roller module 40. The feeding roller module 30 abuts against the part of the separation roller module 40 exposed beyond the platform 11. The pickup roller module 20 is disposed above the platform 11 and contacts the at least one piece of the paper 200. Specifically, the feeding roller module 30 abuts against the part of the separation roller 42 exposed beyond the platform 11. The pickup roller module 20 is disposed above the platform 11 and contacts the plurality pieces of the paper 200.

In this third preferred embodiment, an uppermost piece of the paper 200 of which a surface contacts the at least one of the pickup roller module 20 and the feeding roller module 30 is picked up, and the uppermost piece of the paper 200 of which the surface contacts the at least one of the pickup roller module 20 and the feeding roller module 30 is fed to a downstream position of the paper pickup mechanism 400 along the paper feeding direction F.

Referring to FIG. 1 to FIG. 16, when the blocking board 12 moves to the paper blocking position for blocking each piece of the paper 200 which is to be fed in, a distance D2 between the blocking board 12, and a contact point P2 between the pickup roller module 20 and the uppermost piece of the paper 200 which is to be fed in and contacts the pickup roller module 20 is less than or equal to the energy storage trip G of the energy storage element 50. The contact point P2 is located between the upstream position of the surface of the pickup roller module 20 and the uppermost piece of the paper 200 which is to be fed in and contacts the pickup roller module 20.

Referring to FIG. 1 to FIG. 17, a paper pickup mechanism 500 in accordance with a fourth preferred embodiment of the present invention is shown. Differences between the paper pickup mechanism 400 in accordance with the third preferred embodiment and the paper pickup mechanism 500 in accordance with the fourth preferred embodiment are described as follows. The energy storage element 50 is the tension spring 52. One end of the tension spring 52 has the semicircular first fastening foot 521 fastened to the one end of the separation shaft 41, and the other end of the tension spring 52 has the semicircular second fastening foot 522 fastened to the mechanical frame 10. The one end of the separation shaft 41 is fastened with the second fastening shaft 415. The one side of the outer peripheral surface of the outer end of the second fastening shaft 415 protrudes outward to form the second protruding block 416. The second protruding block 416 opens the fastening hole 417. The first fastening foot 521 is fastened in the fastening hole 417. The middle of the one side wall of the fastening hole 417 is of the lying cylinder shape and is defined as the fastening cylinder 418. The first fastening foot 521 is of the semicircular shape and is worn around the fastening cylinder 418.

Referring to FIG. 1 to FIG. 16, a working principle of the paper pickup mechanism 400 is described as follows. The pickup roller module 20 and the feeding roller module 30 pick up the uppermost piece of the paper A1 abutting against the pickup roller module 20 and the feeding roller module 30, and the pickup roller module 20 and the feeding roller module 30 feed the uppermost piece of the paper A1 abutting against the pickup roller module 20 and the feeding roller module 30 to the downstream position of the paper pickup mechanism 400. The feeding roller module 30 cooperates with the separation roller module 40 to separate the plurality pieces of the paper 200 to block the fed superfluous paper 200, so that just the uppermost piece of the paper A1 is fed to the downstream position of the paper pickup mechanism 400.

Referring to FIG. 1 to FIG. 16 again, when the plurality pieces of the paper 200 are fed into the paper pickup mechanism 400 under an abnormal placement status, a distance L2 between a tail end of one piece of the paper 200 nearest to the pickup roller module 20 and a tail end of another piece of the paper 200 furthest to the pickup roller module 20 is smaller than the distance D2 between the blocking board 12, and the contact point P2 of the pickup roller module 20 and the uppermost piece of the paper 200 which is to be fed in and contacts the pickup roller module 20.

When the friction force exerted on the separation roller 42 by the feeding roller module 30 is less than the preset friction value, namely the friction force between the separation roller module 40, and the feeding roller module 30 together with the fed paper 200 is less than the preset friction value, the separation roller 42 stops rotating together with the feeding roller module 30, the torsion limiter 43 will be fastened with the separation shaft 41, the energy storage element 50 which is the torsion spring 51, the tension spring 52, the plate spring, the compressed spring and so on, releases the energies to make the separation shaft 41 and the separation roller 42 rotate in the reverse direction to drive the paper A2 to slip, and return to an upstream position of the paper pickup mechanism 400, the feeding roller module 30 continues feeding the uppermost piece of the paper A1 to the downstream position of the paper pickup mechanism 400.

As described above, when the separation roller module 40 rotates together with the feeding roller module 30, the paper pickup mechanism 100, the paper pickup mechanism 300, the paper pickup mechanism 400 or the paper pickup mechanism 500 accumulates the energies by virtue of the energy storage element 50 which is the torsion spring 51, the tension spring 52 or so on being mounted between the separation roller module 40 and the mechanical frame 10, when more than one piece of the paper 200 is fed into the paper pickup mechanism 100, the paper pickup mechanism 300, the paper pickup mechanism 400 or the paper pickup mechanism 500, the energy storage element 50 releases the energies to make the separation roller module 40 rotate in the reverse direction opposite to the forward direction and return the fed superfluous paper 200 which is fed into the paper pickup mechanism 100, the paper pickup mechanism 300, the paper pickup mechanism 400 or the paper pickup mechanism 500 out of order, so that a circumstance of more than one piece of the paper 200 being fed in is prevented from being occurred, and correspondingly, a circumstance of the multiple pieces of the paper 200 being fed in is prevented from being occurred. In addition, a manufacturing cost of the paper pickup mechanism 100, the paper pickup mechanism 300, the paper pickup mechanism 400 or the paper pickup mechanism 500 is lower, and an occupying space of the paper pickup mechanism 100, the paper pickup mechanism 300, the paper pickup mechanism 400 or the paper pickup mechanism 500 is smaller.

What is claimed is:

1. A paper pickup mechanism, comprising:

a mechanical frame having a platform for placing at least one piece of paper;

a pickup roller module pivoted to and connected to the mechanical frame, a part of the pickup roller module being exposed beyond the platform and contacting the at least one piece of the paper;

a feeding roller module pivoted to and connected to the mechanical frame, and the feeding roller module being disposed to a downstream position of the pickup roller module, a part of the feeding roller module being exposed beyond the platform;

a driving device mounted to the mechanical frame, the driving device being connected with the pickup roller module and the feeding roller module, the driving device driving the pickup roller module and the feeding roller module to rotate in a forward direction, the at least one piece of the paper of which a surface contacts at least one of the pickup roller module and the feeding roller module being picked up, and the at least one piece of the paper of which the surface contacts the at least one of the pickup roller module and the feeding roller module being fed to a downstream position of the paper pickup mechanism;

a separation roller module pivoted to and connected to the mechanical frame, and the separation roller module being opposite to the feeding roller module, the separation roller module being capable of abutting against the part of the feeding roller module exposed beyond the platform, and the separation roller module being capable of rotating along with the feeding roller module, the separation roller module cooperating with the feeding roller module to separate the at least one piece of the paper, the separation roller module including a separation shaft pivoted to and connected to the mechanical frame, and a separation roller pivoted around and connected to the separation shaft, the separation roller abutting against the part of the feeding roller module exposed beyond the platform; and an energy storage element mounted between the mechanical frame and the separation roller module, when the separation roller module rotates together with the feeding roller module in the forward direction, the energy storage element accumulating energies, when more than one piece of the paper is fed into the paper pickup mechanism, the energy storage element releasing the energies to make the separation roller module rotate in a reverse direction opposite to the forward direction and return fed superfluous paper which is fed into the paper pickup mechanism out of order, the energy storage element being a torsion spring, the torsion spring having a spring body worn around the separation shaft, the spring body being located at one side of the separation roller, one end of the spring body having a first spring foot fastened to one end of the separation shaft, and the other end of the spring body having a second spring foot fastened to the mechanical frame;

wherein the one end of the separation shaft is fastened with a first fastening shaft, an outer peripheral surface of an outer end of the first fastening shaft protrudes outward to form a first protruding block, the first protruding block opens a clamping slot longitudinally penetrating through the first protruding block, and the first spring foot is clamped in the clamping slot.

2. The paper pickup mechanism as claimed in claim 1, wherein the separation shaft is equipped with a torsion limiter, the torsion limiter is buckled with the separation roller, the torsion limiter is capable of being fastened with or being loosened from the separation shaft, when each piece of the paper is fed into the paper pickup mechanism normally, the torsion limiter is fastened with the separation shaft to make the separation roller and the separation shaft of the separation roller module rotate together with the feeding roller module, after a friction force between the separation roller module, and the feeding roller module together with the fed paper reaches a preset friction value, the torsion limiter is loosened from the separation shaft to make the separation roller rotate along with the feeding roller module, the separation shaft keeps a relative fixation.

3. The paper pickup mechanism as claimed in claim 1, wherein the mechanical frame is provided with a blocking board connected with the driving device, the driving device drives the blocking board to alternately move towards a paper blocking position and a paper releasing position relative to the platform, the blocking board is disposed among the pickup roller module, the feeding roller module and the separation roller module, when the blocking board moves to the paper blocking position for blocking each piece of the paper which is to be fed in, a distance between the blocking board and a contact point of the pickup roller module and the paper which is to be fed in and contacts the pickup roller module is less than or equal to an energy storage trip of the energy storage element, when the blocking board moves towards the paper releasing position, the energy storage element starts proceeding accumulating the energies for a first time, and the energy storage element completes accumulating the energies before a front end of one piece of the paper abuts against a separation roller of the separation roller module.

4. The paper pickup mechanism as claimed in claim 3, wherein the energy storage trip is a rotation arc length of a separation roller of the separation roller module driven by the energy storage element.

5. The paper pickup mechanism as claimed in claim 4, wherein the rotation arc length of the separation roller of the separation roller module driven by the energy storage element is capable of being a quarter of a perimeter of the separation roller.

6. A paper pickup mechanism, comprising:

a mechanical frame having a platform for placing at least one piece of paper;

a pickup roller module pivoted to and connected to the mechanical frame, a part of the pickup roller module being exposed beyond the platform and contacting the at least one piece of the paper;

a feeding roller module pivoted to and connected to the mechanical frame, and the feeding roller module being disposed to a downstream position of the pickup roller module, a part of the feeding roller module being exposed beyond the platform;

a driving device mounted to the mechanical frame, the driving device being connected with the pickup roller module and the feeding roller module, the driving device driving the pickup roller module and the feeding roller module to rotate in a forward direction, the at least one piece of the paper of which a surface contacts at least one of the pickup roller module and the feeding roller module being picked up, and the at least one piece of the paper of which the surface contacts the at least one of the pickup roller module and the feeding roller module being fed to a downstream position of the paper pickup mechanism;

a separation roller module pivoted to and connected to the mechanical frame, and the separation roller module being opposite to the feeding roller module, the separation roller module being capable of abutting against the part of the feeding roller module exposed beyond the platform, and the separation roller module being capable of rotating along with the feeding roller module, the separation roller module cooperating with the feeding roller module to separate the at least one piece of the paper, the separation roller module including a separation shaft pivoted to and connected to the mechanical frame, and a separation roller pivoted around and connected to the separation shaft, the separation roller abutting against the part of the feeding roller module exposed beyond the platform; and an energy storage element mounted between the mechanical frame and the separation roller module, when the separation roller module rotates together with the feeding roller module in the forward direction, the energy storage element accumulating energies, when more than one piece of the paper is fed into the paper pickup mechanism, the energy storage element releasing the energies to make the separation roller module rotate in a reverse direction opposite to the forward direction and return fed superfluous paper which is fed into the paper pickup mechanism out of order, the energy storage element being a tension spring, one end of the tension spring having a first fastening foot fastened to one end of the separation shaft, and the other end of the tension spring having a second fastening foot fastened to the mechanical frame;

wherein the one end of the separation shaft is fastened with a second fastening shaft, one side of an outer peripheral surface of an outer end of the second fastening shaft protrudes outward to form a second protruding block, the second protruding block opens a fastening hole, and the first fastening foot is fastened in the fastening hole.

7. The paper pickup mechanism as claimed in claim 6, wherein a middle of one side wall of the fastening hole is of a lying cylinder shape and is defined as a fastening cylinder, the first fastening foot is of a semicircular shape and is worn around the fastening cylinder.

8. A paper pickup mechanism, comprising:

a mechanical frame having a platform for placing at least one piece of paper, the mechanical frame being provided with a blocking board connected with a driving device, the driving device driving the blocking board to alternately move towards a paper blocking position and a paper releasing position relative to the platform;

a pickup roller module pivoted to and connected to the mechanical frame, and contacting the at least one piece of the paper;

a feeding roller module pivoted to and connected to the mechanical frame, and the feeding roller module being disposed to a downstream position of the pickup roller module;

a separation roller module pivoted to and connected to the mechanical frame, the separation roller module being opposite to the feeding roller module, the separation roller module being capable of abutting against the feeding roller module; and an energy storage element mounted between the mechanical frame and the separation roller module, when the separation roller module rotates together with the feeding roller module in a forward direction, the energy storage element accumulating energies, when more than one piece of the paper is fed into the paper pickup mechanism, the energy storage element releasing the energies to make the separation roller module rotate in a reverse direction opposite to the forward direction and return fed superfluous paper which is fed into the paper pickup mechanism out of order, wherein the blocking board is disposed among the pickup roller module, the feeding roller module and the separation roller module, when the blocking board moves to the paper blocking position for blocking each piece of the paper which is to be fed in, a distance between the blocking board, and a contact point of the pickup roller module and the paper which is to be fed in and contacts the pickup roller module is less than or equal to an energy storage trip of the energy storage element, when the at least one piece of the paper is picked up, the blocking board moves towards the paper releasing position, the pickup roller module and the feeding roller module rotate in the forward direction, the pickup roller module brings along a front end of the at least one piece of the paper abuts against a surface of a separation roller of the separation roller module, respectively.

9. The paper pickup mechanism as claimed in claim 8, wherein when the at least one piece of the paper is fed into the paper pickup mechanism under an abnormal placement status, a distance between a tail end of one piece of the paper nearest to the pickup roller module and a tail end of another piece of the paper furthest to the pickup roller module is smaller than a distance between the blocking board, and the contact point of the pickup roller module and the paper which is to be fed in and contacts the pickup roller module.

10. The paper pickup mechanism as claimed in claim 9, wherein the contact point is located between an upstream position of a surface of the pickup roller module and an uppermost piece of the paper which is to be fed in and contacts the pickup roller module.

11. The paper pickup mechanism as claimed in claim 9, wherein the contact point is located between an upstream position of a surface of the pickup roller module and a lowest piece of the paper which is to be fed in and contacts the pickup roller module.

12. The paper pickup mechanism as claimed in claim 8, wherein the energy storage trip is a rotation arc length of the separation roller of the separation roller module driven by the energy storage element.

13. The paper pickup mechanism as claimed in claim 12, wherein the rotation arc length of the separation roller of the separation roller module driven by the energy storage element is capable of being a quarter of a perimeter of the separation roller.

14. The paper pickup mechanism as claimed in claim 8, wherein the energy storage element is one of a torsion spring and a tension spring.

* * * * *